US010559280B2

(12) United States Patent
Bae et al.

(10) Patent No.: US 10,559,280 B2
(45) Date of Patent: Feb. 11, 2020

(54) OPERATING METHOD USING GAMMA VOLTAGE CORRESPONDING TO DISPLAY CONFIGURATION AND ELECTRONIC DEVICE SUPPORTING THE SAME

(71) Applicant: Samsung Electronics Co., Ltd., Gyeonggi-do (KR)

(72) Inventors: Jong Kon Bae, Seoul (KR); Dong Kyoon Han, Gyeonggi-do (KR); Dong Hwy Kim, Gyeonggi-do (KR); Kyong Rok Kang, Gyeonggi-do (KR); Dong Hun Kim, Seoul (KR); Jung Chul An, Gyeonggi-do (KR); Joung Min Cho, Seoul (KR); Kwang Tai Kim, Gyeonggi-do (KR); Hyung Sup Byeon, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/920,943

(22) Filed: Mar. 14, 2018

(65) Prior Publication Data

US 2018/0268780 A1 Sep. 20, 2018

(30) Foreign Application Priority Data

Mar. 14, 2017 (KR) ..... 10-2017-0031868

(51) Int. Cl.
*G09G 5/10* (2006.01)
*G09G 5/00* (2006.01)

(52) U.S. Cl.
CPC ..... *G09G 5/10* (2013.01); *G09G 5/008* (2013.01); *G09G 2320/0673* (2013.01)

(58) Field of Classification Search
None
See application file for complete search history.

(56) References Cited

U.S. PATENT DOCUMENTS 8,823,753 B2 9/2014 Kim et al.
9,837,040 B2 12/2017 Moon et al.
(Continued)

FOREIGN PATENT DOCUMENTS

KR 100829458 5/2008
KR 20080105977 12/2008
(Continued)

OTHER PUBLICATIONS

International Search Report dated Jun. 28, 2018 issued in counterpart application No. PCT/KR2018/003000, 11 pages.
(Continued)

*Primary Examiner* — Kenneth B Lee, Jr.
(74) *Attorney, Agent, or Firm* — The Farrell Law Firm, P.C.

(57) ABSTRACT

An electronic device and a method of operating the electronic device using a gamma voltage of a display panel are provided. The electronic device includes a display panel, and a display driver integrated circuit. The display driver integrated circuit includes a source driver including source amplifiers to amplify output signals to be output through sub-pixels included in each pixel of the display panel, a gamma voltage output circuit that outputs one or more gamma voltages for correcting gray scales of the output signals depending on characteristics of the sub-pixels, a gamma adjustment circuit that provides reference voltages for the gamma voltages to the gamma voltage output circuit and includes signal lines connected with the gamma voltage output circuit, and switches connected between the signal lines.

20 Claims, 11 Drawing Sheets

(56) References Cited

U.S. PATENT DOCUMENTS

| | | | | |
|---|---|---|---|---|
| 9,842,560 | B2 | 12/2017 | Kim et al. | |
| 2008/0291190 | A1* | 11/2008 | Kim | G09G 3/3648 345/211 |
| 2010/0225678 | A1 | 9/2010 | Kim et al. | |
| 2011/0133972 | A1 | 6/2011 | Na et al. | |
| 2013/0135362 | A1 | 5/2013 | Kim et al. | |
| 2016/0098959 | A1 | 4/2016 | Moon et al. | |
| 2016/0098966 | A1 | 4/2016 | Kim et al. | |
| 2016/0189635 | A1 | 6/2016 | Lee et al. | |
| 2017/0336851 | A1 | 11/2017 | Bae et al. | |

FOREIGN PATENT DOCUMENTS

| | | |
|---|---|---|
| KR | 20100005929 | 1/2010 |
| KR | 1020160082877 | 7/2016 |
| WO | WO 2017/200352 | 11/2017 |

OTHER PUBLICATIONS

European Search Report dated Nov. 15, 2019 issued in counterpart application No. 18767983.2-1209, 13 pages.

* cited by examiner

OPERATING METHOD USING GAMMA VOLTAGE CORRESPONDING TO DISPLAY CONFIGURATION AND ELECTRONIC DEVICE SUPPORTING THE SAME

CROSS-REFERENCE TO RELATED APPLICATION(S)

This application claims is based on and claims priority under 35 U.S.C. § 119 to Korean Patent Application Serial No. 10-2017-0031868, filed on Mar. 14, 2017, in the Korean Intellectual Property Office, the disclosure of which is incorporated by reference herein in its entirety.

BACKGROUND

1. Field

The present disclosure relates generally to an operating method of an electronic device using a gamma voltage corresponding to a display configuration.

2. Description of Related Art

An electronic device includes a display for displaying information. The power consumption of the display accounts for most of the total power consumption of the electronic device.

Accordingly, in an electronic device employing a limited power resource, e.g., a battery, there is a need to reduce power consumption of the display in order to significantly decrease total power consumption.

SUMMARY

The present disclosure is made to address at least the above-mentioned problems and/or disadvantages and to provide at least the advantages described below.

Accordingly, an aspect of the present disclosure is to provide an operating method for an electronic device using a gamma voltage corresponding to a display configuration (or setting, or mode, or state), which saves power by using gamma voltages (e.g., gamma tap voltages) for some sub-pixels according to the display configuration, and an electronic device supporting the same.

In accordance with an aspect of the present disclosure, an electronic device is provided. The electronic device includes a display panel and a display driver integrated circuit, which includes a source driver including source amplifiers configured to amplify output signals to be output through sub-pixels included in each pixel of the display panel; a gamma voltage output circuit configured to output gamma voltages for correcting gray scales of the output signals depending on characteristics of the sub-pixels; a gamma adjustment circuit configured to provide reference voltages to the gamma voltage output circuit, the gamma adjustment circuit including signal lines connected with the gamma voltage output circuit; and switches connected between the signal lines.

In accordance with an aspect of the present disclosure, an electronic device is provided. The electronic device includes a display panel including a plurality of source channels; and a display driver integrated circuit, which includes a source driver including source amplifiers configured to supply signals to the source channels, respectively, and decoders connected with input terminals of the source amplifiers, respectively; a gamma generator configured to supply gamma voltages to the source driver; and a timing controller configured to control gamma voltage generation of the gamma generator, wherein the gamma generator includes circuit devices for sub-pixels, the circuit devices configured to supply the gamma voltages to the decoders; and a switch configured to selectively connect a first circuit device among the circuit devices, which is configured to supply a first gamma voltage to a first decoder among the decoders, with a second circuit device configured to supply a second gamma voltage to a second decoder among the decoders, in response to a control signal.

In accordance with an aspect of the present disclosure, an operating method is provided for an electronic device using a gamma voltage of a display panel including a plurality of channels. The method includes determining a screen display configuration of the display panel; if the determined screen display configuration is a first screen display configuration, supplying gamma voltages to sub-pixels by using some of circuit devices for the sub-pixels, which supply the gamma voltages to source channels; and if the determined screen display configuration is a second screen display configuration, which is different from the first screen display configuration, supplying second gamma voltages to the sub-pixels by using each of the circuit devices for the sub-pixels, which supply the gamma voltages to the source channels.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
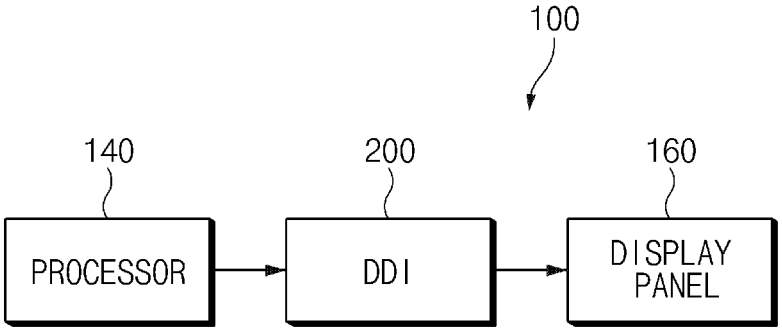
FIG. 1 illustrates an electronic device including a DDI, according to an embodiment.

Various embodiments of the present disclosure are described below with reference to the accompanying drawings. Accordingly, those of ordinary skill in the art will recognize that modifications, equivalents, and/or alternatives of the various embodiments described herein may be made without departing from the scope and spirit of the present disclosure. With regard to the drawings and the descriptions thereof, similar elements may be referenced by similar reference numerals.

Terms and expressions used in the present disclosure are used to describe specified embodiments and are not intended to limit the scope of the present disclosure. The terms of a singular form may include plural forms unless otherwise specified.

Unless otherwise defined as such herein, all the terms used herein, which include technical or scientific terms, may have the same meanings that are generally understood by a person of ordinary skill in the art. Terms that are defined in a dictionary and commonly used should also be interpreted as is customary in the relevant related art and not in an idealized or overly formal way, unless expressly defined as such herein. In some cases, even if terms are defined in the specification, they may not be interpreted to exclude embodiments of the present disclosure.

Herein, the expressions "have", "may have", "include", "comprise", "may include", and "may comprise" indicate the existence of corresponding features (e.g., elements such as numeric values, functions, operations, or components) but do not exclude presence of additional features.

The expressions "A or B", "at least one of A or/and B", "one or more of A or/and B", etc., may include any and all combinations of one or more of the associated listed items. For example, the expression "A or B", "at least one of A and B", or "at least one of A or B" may refer to (1) where at least one A is included, (2) where at least one B is included, or (3) where both of at least one A and at least one B are included.

Numerical terms, such as "first", "second", etc., may refer to various elements of various embodiments, but do not limit the elements. Such terms may be used to distinguish one element from another element. For example, "a first user device" and "a second user device" may indicate different user devices, regardless of the order or priority thereof.

When an element (e.g., a first element) is referred to as being "(operatively or communicatively) coupled with/to" or "connected to" another element (e.g., a second element), the first element may be directly coupled with/to or connected to the second element or an intervening element (e.g., a third element) may be present therebetween. In contrast, when the first element is referred to as being "directly coupled with/to" or "directly connected to" the second element, no intervening element may be present therebetween.

According to context, the expression "configured to" may be used as "suitable for", "having the capacity to", "designed to", "adapted to", "made to", or "capable of". The term "configured to" does not mean only "specifically designed to" in terms of hardware. Instead, "a device configured to" may indicate that the device is "capable of" operating together with another device or other components. A "processor configured to perform A, B, and C" may indicate a dedicated processor (e.g., an embedded processor) for performing a corresponding operation or a generic-purpose processor (e.g., a central processing unit (CPU) or an application processor (AP)), which may perform corresponding operations by executing one or more software programs stored in a memory device.

An electronic device according to an embodiment may include a smartphone, a tablet personal computer (PC), a mobile phone, a video telephone, an e-book reader, a desktop PC, a laptop PC, a netbook computer, a workstation, a server, a personal digital assistant (PDA), a portable multimedia player (PMP), a Motion Picture Experts Group (MPEG-1 or MPEG-2) Audio Layer 3 (MP3) player, a mobile medical device, a camera, a wearable device (e.g., a head-mounted-device (HMD), such as electronic glasses), an electronic apparel, an electronic bracelet, an electronic necklace, an electronic appcessory, an electronic tattoo, a smart watch, etc.

An electronic device may also be a home appliance, such as a television (TV), a digital versatile disc (DVD) player, an audio device, a refrigerator, an air conditioner, a cleaner, an oven, a microwave oven, a washing machine, an air cleaner, a set-top box, a home automation control panel, a security control panel, a TV box (e.g., Samsung HomeSync™, Apple™, or Google TV™), a game console (e.g., Xbox™ or PlayStation™), an electronic dictionary, an electronic key, a camcorder, an electronic picture frame, etc.

An electronic devices may also be a medical device (e.g., a portable medical measurement device, such as a blood glucose monitoring device, a heartbeat measuring device, a blood pressure measuring device, a body temperature measuring device, etc., a magnetic resonance angiography (MRA) device, a magnetic resonance imaging (MRI) device, a computed tomography (CT) device, a scanner, and an ultrasonic device), a navigation device, a global positioning system (GPS) receiver, an event data recorder (EDR), a flight data recorder (FDR), a vehicle infotainment device, electronic equipment for vessels (e.g., a navigation system and a gyrocompass), an avionics device, a security device, a head unit for a vehicle, an industrial or home robot, an automatic teller machine (ATM), a points of sales (POS) device, or an Internet of things (IoT) device (e.g., a light bulb, a sensor, an electric or gas meter, a sprinkler device, a fire alarm, a thermostat, a street lamp, a toaster, exercise equipment, a hot water tank, a beater, a boiler, etc.).

An electronic device may be a part of furniture or a building/structure, an electronic board, an electronic signature receiving device, a projector, or a measuring instrument (e.g., a water meter, an electricity meter, a gas meter, a wave meter, etc.).

An electronic device may also be a flexible device.

An electronic device may also be a combination of the above-described devices.

Further, an electronic device may not be limited to the above-described electronic devices and may include other electronic devices and new electronic devices according to the development of technologies.

Herein, the term "user" may refer to a person who uses an electronic device or may refer to a device (e.g., an artificial intelligence electronic device) that uses an electronic device.

FIG. 1 illustrates an electronic device including a DDI, according to an embodiment.

Referring to FIG. 1, an electronic device 100 includes a processor 140 (e.g., an AP), a DDI 200, and a display panel 160. For example, the electronic device 100 may be a portable electronic device. The DDI 200 and the display panel 160 may be implemented with a separate (or external) display device (or a display module or a display) except for the processor 140.

The display panel 160 includes a plurality of source amplifiers. When a plurality of source channels (or source lines, or grouped source channels) are provided in each source amplifier to be driven (or allocated), a gamma voltage (or a gamma tap voltage) of a gamma generator for a specified sub-pixel may be used as a gamma voltage (or a gamma tap voltage) for at least one other sub-pixel adjacent to the specified sub-pixel. Devices (e.g., at least one device included in a gamma circuit related to other sub-pixels sharing the gamma voltage with the specified sub-pixel) associated with the other sub-pixels sharing the gamma voltage with the specified sub-pixel may be turned off. Accordingly, the electronic device 100 may save power consumption in the gamma generator.

The processor 140 may control the overall operation of the electronic device 100. The processor 140 may be implemented with an IC, a system on chip (SoC), or a mobile AP. The processor 140 may transmit desired display data (e.g., image data, moving picture data, still image data, etc.) to the DDI 200. The display data may be divided in a line data unit corresponding to a horizontal line (or a vertical line) of the display panel 160. The processor 140 may transmit a control signal to the DDI 200 to control operations of the gamma generator of the display panel 160 according to the display configurations (or settings, modes, states, instructions, or functions).

When the electronic device 100 has first screen display configuration, the processor 140 may process the supply of the gamma voltage (or a gamma tap voltage) using only some circuit elements of circuit devices for each sub-pixel of the gamma generator.

For example, the first screen display configuration may include a configuration for displaying only a clock object on a screen, an object to provide weather information, an object to display a received message (e.g., a chatting message, a text message, an e-mail message, etc.), an object to display a missed call, a schedule-related object, etc., on the display panel 160. Alternatively, the first screen display configuration may include a configuration for driving the display panel 160 with a brightness less than a first intensity, a configuration for displaying a screen with a brightness less than a specified intensity, and/or an always on display (AOD) configuration.

In an AOD state, the sharing function of the gamma tap voltage may be processed by the DDI 200, while the processor 140 is maintained in a sleep state. In this connection, the processor 140 may provide a control signal, which is associated with the sharing of the gamma tap voltage, to the DDI 220 for screen display in the transition to the sleep state. The DDI 220 may perform signal processing associated with the sharing of the gamma tap voltage when the processor 140 is in the sleep state.

Alternatively, the processor 140 may include the DDI 200. At least a part of the processor 140 including the DDI 220 may be activated according to a screen display configuration.

The electronic device 100 may include a plurality of processors, e.g., a general processor and a lower-power processor, which may be selectively operated according to the screen display configuration. For example, when the general processor is in the sleep state according to screen display based on the AOD, the lower-power processor may perform function processing associated with the sharing of the gamma tap voltage. The lower-power processor may be provided in the form of additional hardware distinguished from the general processor. In addition, the lower-power processor may include the DDI 220.

When the electronic device 100 has second screen display configuration, the processor 140 may process the supply of a gamma voltage (or a gamma tap voltage) based on all of the circuit elements of sub-pixels of the gamma generator or based on more circuit elements than when the gamma generator operated in the first screen display configuration (or lower-brightness screen display configuration).

The second screen display configuration may include a configuration for outputting a screen, such as a standby screen, an execution screen of a specified application such as a moving picture, a conversation screen, a web-surfing screen, or a screen for writing a text message, a configuration for displaying a screen with a brightness that is greater than or equal to a specified first intensity, or a configuration for displaying the screen of the display panel 160 with a brightness that is greater than or equal to a specified second brightness. The second screen display configuration may be executed by a preset scheduling event (e.g., an event made at a specified time while a specified condition is satisfied, after the execution screen of the specified application is output in the second screen display configuration) or a user input event for requesting to change the display configuration.

The DDI 200 may change data received from the processor 140 into a form capable of being transmitted to the display panel 160 and may provide the changed data to the display panel 160. The changed data (or display data) may be supplied in a pixel unit (or a sub-pixel unit). To display a specified color, a pixel may have a structure in which sub-pixels (Red, Green, and Blue) are disposed adjacent to each other. One pixel may include RGB sub-pixels (e.g., an RGB stripe layout structure) or may include RGBG sub-pixels (e.g., a Pentile layout structure). An arrangement structure of the RGBG sub-pixels may be replaced with an arrangement structure of RGGB sub-pixels. The arrangement structure of the RGBG sub-pixels may be replaced with an arrangement structure of RGBW sub-pixels.

The DDI 200 may process display data to be transmitted to the display panel 160 in a pixel unit according to the display configurations. For example, the DDI 200 may turn on some elements of the gamma generator under the control of the processor 140 in order to generate a gamma tap voltage of a specified sub-pixel and may use the generated gamma tap voltage a gamma tap voltages of other sub-pixels. In this operation, the DDI 200 may cut off the supply of power to circuits for generating gamma tap voltages of other sub-pixels (i.e., sub-pixels used by sharing the gamma tap voltage of the specified sub-pixel), thereby reducing power consumption in the operations of the other sub-pixels.

The DDI 200 may use outputs of a plurality of source amplifiers allocated with a plurality of sub-pixels as outputs of other source amplifiers allocated with a plurality of sub-pixels. For example, in a layout structure including the RGB sub-pixels (e.g., a structure or a state that a Red sub-pixel is connected with a first source amplifier, a Green sub-pixel is connected with a second source amplifier, and a Blue sub-pixel is connected with a third source amplifier), the DDI 200 may turn off at least one of the second source amplifier or the third source amplifier and may supply the output of the first source amplifier to other source lines, according to the display configurations. Accordingly, the electronic device 100 operates some source amplifiers to operate the display panel 160 under relatively low power, as compared operating all source amplifiers.

The display panel 160 may display data by the DDI 200. The display panel 160 may be implemented with a thin film transistor liquid crystal display (TFT-LCD) panel, a light-emitting diode (LED) display panel, an organic LED (OLED) display panel, an active-matrix OLED (AMOLED) display panel, a flexible display, etc.

The display panel 160 may include gate lines and source lines crossing each other in a matrix form. Gate signals may be supplied to the gate lines. The gate signals may be sequentially supplied to the gate lines. A first gate signal may be supplied to each odd-numbered gate line among the gate lines, and a second gate signal may be supplied to each even-numbered gate line among the gate lines. The first gate signal and the second gate signal may include signals that are alternately supplied.

Alternatively, after first gate signals are sequentially supplied to the odd-numbered gate lines from a start line to an end line thereof, second gate signals may sequentially supplied to the even-numbered gate lines from a start line to an end line thereof. A signal corresponding to display data may be supplied to each of the source lines. The signal corresponding to the display data may be received from a source driver under control of the timing controller of a logic circuit.

Figure 2:
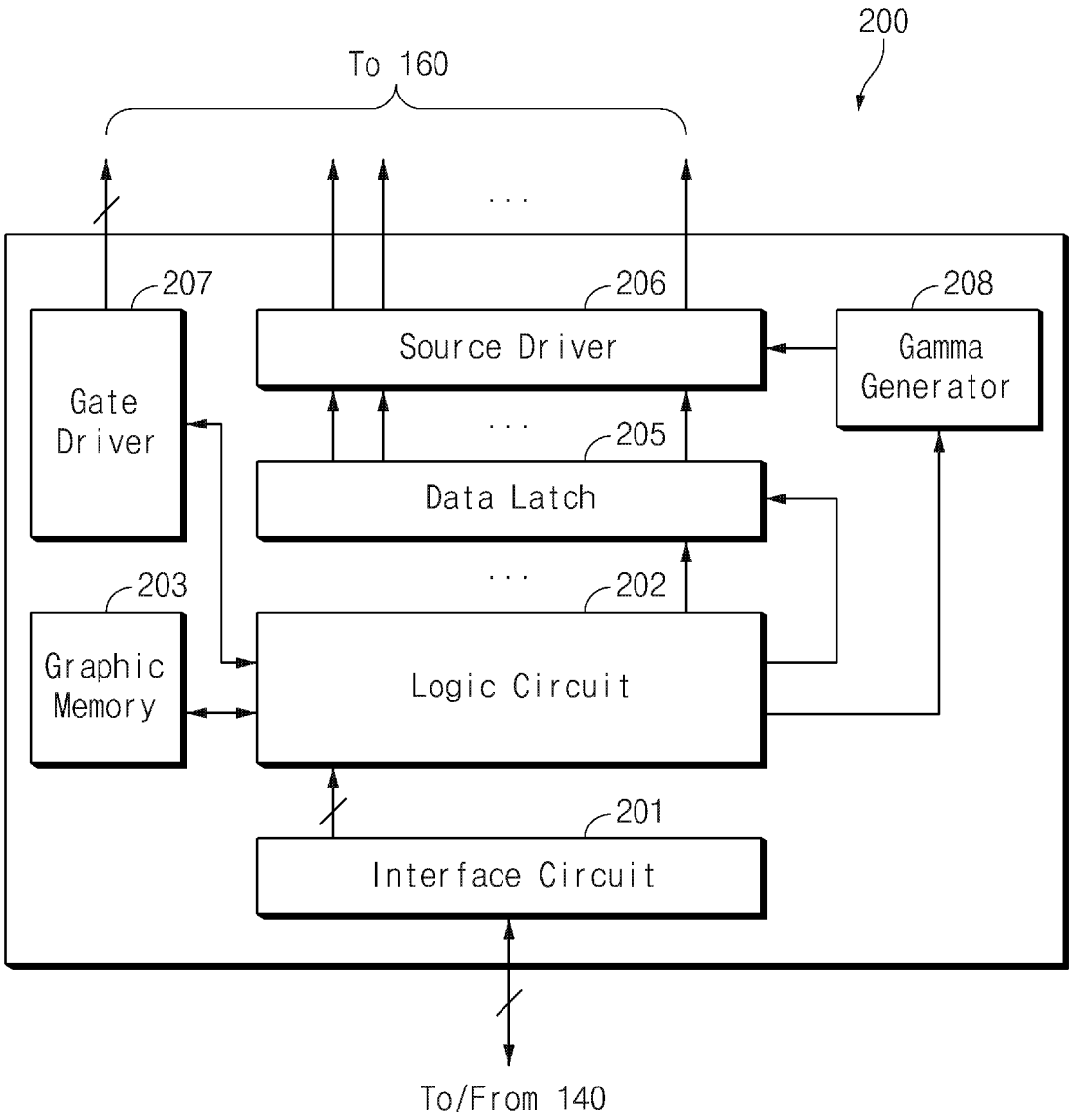
FIG. 2 illustrates a DDI, according to an embodiment.

FIG. 2 illustrates a DDI according to an embodiment;

Referring to FIG. 2, the DDI 200 includes an interface circuit 201, a logic circuit 202, a graphic memory 203, a data latch (or shift register) 205, a source driver 206, a gate driver 207, and a gamma generator (or gamma circuit) 208.

The interface circuit 201 may interface signals or data exchanged between the processor 140 and the DDI 200. The interface circuit 201 may interface line data from the processor 140 and may provide the line data to a graphics memory write controller of the logic circuit 202. The interface circuit 201 may relate to a serial interface, such as a mobile industry processor interface (MIPI®), a mobile display digital interface (MDDI), a display port, an embedded DisplayPort (eDP), etc.

The logic circuit 202 may include a graphic memory write controller, a timing controller, a graphic memory read controller, an image processing unit, a source shift register controller, and a data shift register.

The graphic memory write controller of the logic circuit 202 may control an operation of receiving line data from the interface circuit 201 and of writing the received line data into the graphic memory 203.

The timing controller may supply a synchronizing signal and/or a clock signal to each element (e.g., a graphic memory read controller) of the DDI 200. In addition, the timing controller may provide the graphic memory read controller with a read command (RCMD) for controlling a read operation of the graphic memory 203. The timing controller may control the source driver 206 to supply display data. The timing controller may control the gate driver 207 to output a gate signal. For example, the timing controller may control the gate driver 207 to sequentially supply gate signals to the gate lines of the display panel 160, or may control the gate driver 207 to output gate signals to the gate lines of the display panel 160 while distinguishing the gate lines between odd-numbered lines and even-numbered lines.

The timing controller may generate and supply digital gamma values according to the display configurations. For example, the timing controller may control timing such that gamma voltages (or gamma tap voltages) for specified sub-pixels are used to generate gamma voltages for other sub-pixels, based on some of circuit devices (or circuit elements) for each sub-pixel of the gamma generator 208 in the first screen display configuration. Alternatively, the timing controller may control timing such that gamma voltages (or gamma tap voltages) for sub-pixels are generated and supplied, based on all of the circuit devices (or circuit elements) of the sub-pixels of the gamma generator 208 in the second screen display configuration. The timing controller may control the source driver 206 to supply the output of a specified source amplifier among a plurality of source amplifiers to other sub-pixels under the control of the timing controller. The timing controller may control the source amplifier and the gamma generator and may control output timing of the source amplifier (e.g., a time-division operation) to supply a gamma voltage, which is to be supplied to a relevant sub-pixel, to a decoder associated with the sub-pixel.

While the gamma generator 208 generates a gamma voltage based on circuit devices corresponding to a specified sub-pixel and transmit the generated gamma voltage to a decoder, the processor 140 or the timing controller may control timing for providing a digital gamma value associated with each sub-pixel. Alternatively, the processor 140 or the timing controller may control timing such that a gamma voltage generated corresponding to a specified sub-pixel is transmitted to a relevant source amplifier through a relevant decoder at specific timing. The timing controller may control timing to generate the output of the source amplifier based on a digital gamma value corresponding to display data for each sub-pixel by controlling output timing of the source amplifier in a time-division manner and to supply the generated output to the sub-pixel.

A graphic memory read controller may perform a read operation for line data stored in the graphic memory 203. The graphic memory read controller may perform a read operation on all or a part of the line data stored in the graphic memory 203, based on an RCMD for the line data. The graphic memory read controller may transmit, to an image processing unit, all or a part of line data read from the graphic memory 203.

Although a graphic memory write controller and the graphic memory read controller are described as being independent from each other for the convenience of explanation, the graphic memory write controller and the graphic memory read controller may be integrated into one graphic memory controller.

The image processing unit may improve an image quality by processing all of the line data from the graphic memory read controller. Display data having improved the image quality may be transmitted to the timing controller, and the timing controller may transmit the display data to the source driver 206 through the data latch 205.

A source shift register controller may control a data shifting operation of a data shift register. The source shift register controller may control a line data write operation into the graphic memory 203, an image pre-processing operation of the image processing unit, etc., in response to an instruction from the processor 140.

The data shift register may shift display data transmitted through the source shift register controller under the control of the source shift register controller. The data shift register may sequentially provide the shifted display data to the data latch 205.

The graphic memory 203 may store line data received through the graphic memory write controller under the control of the graphic memory write controller. The graphic memory 203 may operate as a buffer memory in the DDI 200. The graphic memory 203 may include a graphic random access memory (GRAM).

The data latch 205 may store display data sequentially transmitted from the data shift register. The data latch 204 may output the stored display data to the source driver 206 in units of a horizontal line of the display panel 160.

The source driver 206 may transmit, to the display panel 160, line data received from the data latch 205. The source driver 206 may include a plurality of source amplifiers connected to sub-pixels (or channels allocated to the sub-pixels). The source amplifiers included in the source driver 206 may operate in the time-division manner to provide signals to respective sub-pixels. The source amplifiers included in the source driver 106 may be connected with the same sub-pixels or different sub-pixels. In the structure of the display panel 160 including RGB pixels, the source driver 206 may include source amplifiers connected with sub-pixels (e.g., an R sub-pixel, a G sub-pixel, and a B sub-pixel) and may use an output of a source amplifier of a specific sub-pixel (e.g., the B sub-pixel) among the sub-pixels as an output of a source amplifier of another sub-pixel (e.g., the R sub-pixel or the sub-pixel). For example, when gamma curves of the Red sub-pixel and the Green sub-pixel are identical to or similar to each other, the source driver 206 may turn on share switches connected with output terminals of relevant source amplifiers to provide both Red and Green outputs using one of the outputs of Red and Green source amplifiers.

The source driver 206 may include a plurality of decoders connected with input terminals of source amplifiers connected with sub-pixels. Each of the decoders may be connected with the gamma generator 208 and an output terminal of the logic circuit 202 and may decode (or multiply) display data received from the logic circuit 202 and a gamma voltages provided by the gamma generator 208. Each decoder output may be connected with each source amplifier.

The gate driver 207 may drive the gate lines of the display panel 160. The gate driver 207 may sequentially supply gate signals to gate lines of the display panel 160 under the control of the logic circuit 202. The gate driver 207 may classify the gate lines of the display panel 160 into odd-numbered lines or even-numbered lines under control of the logic circuit 202 and may supply a gate signal to each of the classified lines.

As described above, because operations of pixels in the display panel 160 are controlled by the source driver 206 and the gate driver 207, display data (or an image corresponding to the display data) from the processor 140 may be displayed in the display panel 160.

The gamma generator 208 may generate and supply a gamma value (or a gamma voltage) associated with the brightness adjustment of the display panel 160, based on the circuit devices (or circuit elements) for each sub-pixel. The gamma generator 208 may generate an analog gamma value corresponding to at least one of a first color (e.g., red), a second color (e.g., green), or a third color (e.g., blue), and may supply the analog gamma value to the source driver 206. The analog gamma value may be generated based on a gamma curve stored corresponding to a specified color.

The gamma generator 208 may use a gamma tap voltage of a specified color (e.g., a specified Red or Blue sub-pixel) as a gamma tap voltage of another color (e.g., Green, Blue, or Red) such that the gamma tap voltage is supplied to each decoder of the source driver 206. In this connection, the gamma generator 208 may generate a gamma voltage for each sub-pixel in a time division manner under the control of the logic circuit 202 and may supply the gamma voltage to the source driver 206. For example, the gamma generator 208 may generate a gamma voltage to be supplied to each sub-pixel at every horizontal synchronization (Hsync) period based on the gamma voltage for the specified sub-pixel and may supply the generated gamma voltage to the source driver 206. The length of an Hsync period may vary depending on the driving frequency of the display panel 160.

Figure 3A:
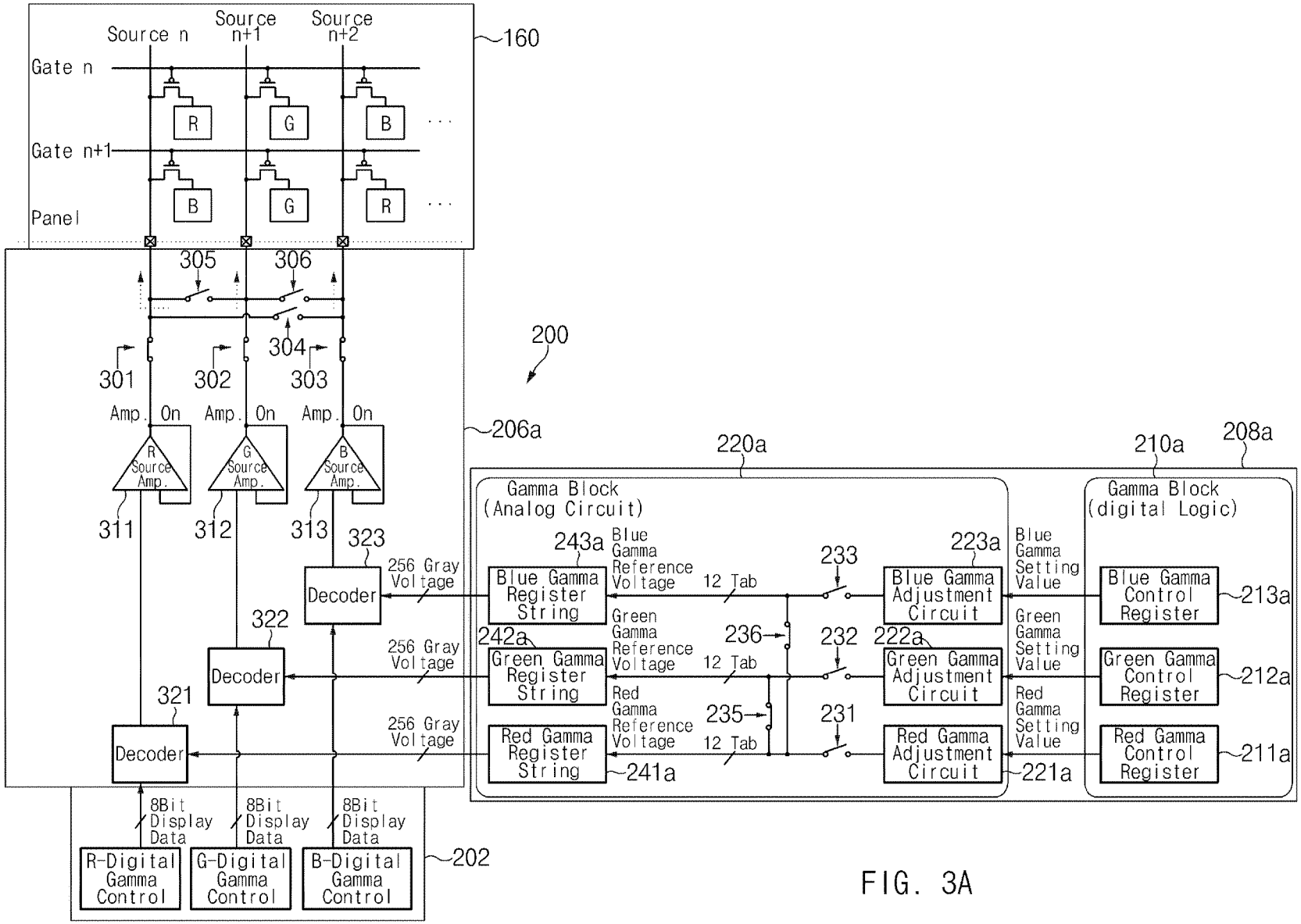
FIG. 3A is a schematic diagram illustrating an electronic device including a display panel, according to an embodiment.

FIG. 3A is a schematic diagram illustrating an electronic device including a display panel, according to an embodiment.

Referring to FIG. 3A, the electronic device 100 includes a display panel 160 having a stripe layout type, and a DDI 200, which includes a first source driver 206*a*, a first gamma generator 208*a*, and a logic circuit 202.

The display panel 160 having the stripe layout type includes a display area in which a plurality of gate lines Gate n and Gate n+1 cross a plurality of stripe source lines Source n, Source n+1, Source n+2, . . . , and Source n+n. The display panel 160 may further include a non-display area including the first source driver 206*a* supplying display data to the gate lines Gate n and Gate n+1 and the stripe source lines Source n, Source n+1, Source n+2, . . . , and Source n+n and a gate driver 207 supplying a gate signal. A pixel of the display panel 160 having the stripe layout type includes three grouped sub-pixels.

The gate lines Gate n and Gate n+1 may be sequentially supplied with gate signals. The gate lines Gate n and Gate n+1 may include odd-numbered gate lines Gate and even-numbered gate lines Gate n+1. The odd-numbered gate lines Gate n and the even-numbered gate lines Gate n+1 may be alternately supplied with gate signals. Pixels arranged on the odd-numbered gate lines Gate n or the even-numbered gate lines Gate n+1 may be grouped by n.

In FIG. 3A, the first gamma generator 208*a* is provided with elements to supply gamma voltages to the odd-numbered gate lines Gate n. The display panel 160 may further include an additional gamma generator to supply gamma voltages to the even-numbered gate lines Gate n+1 (e.g., a gamma generator to supply gamma voltages in the sequence of blue, green, and red). Further, additional switching devices and wirings may be provided such that the first gamma generator 208*a*, which supplies gamma voltages in the sequence of red, green, and blue, supplies the gamma voltages to the even-number gate lines Gate n+1 in the sequence of blue, green, and red.

On each of the stripe source lines Source n, Source n+1, Source n+2, . . . , and Source n+n, Red sub-pixels, Green sub-pixels, or Blue sub-pixels may be arranged. Pads, which are connected with output terminals of source amplifiers of the first source driver 206*a*, may be disposed at one side of the display panel 160, e.g., ends (or ends of some of channels when source lines are expressed as the channels) of some of stripe source lines Source n, Source n Source n+2, . . . , and Source n+n.

The first source driver 206*a* includes a first source amplifier 311, which selectively supplies a signal to some, e.g., the first source channel Source n, among the stripe source lines Source n, Source n+1, Source n+2, . . . , and Source n+n, a second source amplifier 312 that selectively supplies a signal to the second source channel Source n+1, and a third source amplifier 313 that selectively supplies a signal to the third source channel Source n+2. In addition, the first source driver 206*a* includes a first switch 301 connected with an output terminal of the first source amplifier 311, a second switch 302 connected with an output terminal of the second source amplifier 312, and a third switch 303 connected to an output terminal of the third source amplifier 313.

The first source driver 206*a* includes a first share switch 304, which connects the output terminal of the first source amplifier 311 with the output terminal of the third source amplifier 313, a second share switch 305, which connects the output terminal of the first source amplifier 311 with the output terminal of the second source amplifier 312, and a third share switch 306, which connects the output terminal of the second source amplifier 312 with the output terminals of the third source amplifier 313.

A control signal of each of the above switches may be received from the timing controller that receives a control signal of the processor 140. Although FIG. 3A illustrates the first source driver 206*a* including the share switches 304, 305, and 306, the first source driver 206*a* may be provided without the share switches.

The first source driver 206*a* includes a first decoder 321 disposed at an input terminal of the first source amplifier 311, a second decoder 322 disposed at an input terminal of the second source amplifier 312, and a third decoder 323 disposed at an input terminal of the third source amplifier 311. Each of the first, second, and third decoders 321, 322, and 323 may receive display data from the logic circuit 202. In addition, each of the first, second, and third decoders 321, 322, and 323 may receive a gamma voltage generated from the first gamma generator 208*a*.

The first gamma generator 208*a* may generate analog gamma values associated with colors of a first sub-pixel to a third sub-pixel (e.g., RGB sub-pixels) in relation to the display configurations of the display panel 160 and may supply the analog gamma values to the decoders 321, 322, and 323, respectively. In this connection, the first gamma generator 208*a* includes a first analog gamma block (or circuitry) 220*a* and a first digital gamma block (or circuitry) 210*a* as circuit devices (or circuit elements) for the sub-pixels.

The first digital gamma block 210*a* includes a first Red gamma control register 211*a*, a first Green gamma control register 212*a*, and a first Blue gamma control register 213*a*. Each of the first red, green, blue gamma registers 211*a*, 212*a*, and 213*a* may transmit a gamma setting value (or gamma configuration value) corresponding to a relevant sub-pixel to the first analog gamma block 220*a*. The first digital gamma block 210*a* may transmit a digital gamma value (or a gamma setting value) of a specified sub-pixel to the first analog gamma block 220*a* according to the display configuration.

The first digital gamma block 210*a* may transmit, to the first analog gamma block 220*a*, a gamma setting value specified based on the first Red gamma control register 211*a* in the first screen display configuration (e.g., a lower-brightness screen display configuration) of the display panel 160. When the gamma voltage is supplied to the first decoder 321, the specified gamma setting value may include a Red gamma setting value corresponding to the first decoder 321. When the gamma voltage is supplied to the second decoder 322, the specified gamma setting value may include a gamma setting value obtained by mapping a Green gamma setting value corresponding to the second decoder 322 to the Red gamma curve. When the gamma voltage is supplied to the third decoder 323, the specified gamma setting value may include a gamma setting value obtained by mapping a Blue gamma setting value corresponding to the third decoder 323 to the Red gamma curve. In addition, the first digital gamma block 210*a* may transmit only one gamma setting value to the first analog gamma block 220*a*. The first digital gamma block 210*a* may transmit the Red gamma setting value, the Green gamma setting value, and the Blue gamma setting value to the first analog gamma block 220*a* sequentially or in a time-division manner, in the second screen display configuration (a higher-brightness screen display configuration) of the display panel 160.

The first analog gamma block 220*a* may generate specified analog gamma values (or gamma voltages) based on the Red, Green, and Blue gamma setting values, which are received from the first digital gamma block 210*a*, and may supply the generated gamma voltages to the decoders 321, 322, and 323, respectively. In this connection, the first analog gamma block 220*a* includes gamma adjustment circuits (e.g., a first Red gamma adjustment circuit 221*a*, a first Green gamma adjustment circuit 222*a*, and a first Blue gamma adjustment circuit 223*a*) and gamma voltage output circuits (or gamma register strings, such as a first Red gamma register string 241*a*, a first Green gamma register string 242*a*, and a first Blue gamma register string 243*a*). In addition, the first analog gamma block 220*a* includes a first gamma switch 231 interposed between the first Red gamma adjustment circuit 221*a* and the first Red gamma register string 241*a*, a second gamma switch 232 interposed between the first Green gamma adjustment circuit 222*a* and the first Green gamma register string 242*a*, and a third gamma switch 233 interposed between the first Blue gamma adjustment circuit 223*a* and the first Blue gamma register string 243*a*. In addition, the first analog gamma block 220*a* includes a first connection switch 235 interposed between the first Red gamma adjustment circuit 221*a* and the first Green gamma register string 242*a* and a second connection switch 236 interposed between the first Red gamma adjustment circuit 221*a* and the first Blue gamma register string 243*a*. The first gamma switch 231 may be parallel-connected between the first Red gamma register string 241*a* and the first connection switch 235.

In the first screen display configuration, the first Red gamma control register 211*a* may transmit the first gamma setting value (e.g., a Red gamma setting value) to the first Red gamma adjustment circuit 221*a* of the first analog gamma block 220*a*. The first Red gamma adjustment circuit 221*a* may generate a gamma reference voltage (or at least one gamma tap voltages) corresponding to the received first gamma setting value and may provide the gamma reference voltage (or the gamma tap voltage) to the first Red gamma register string 241*a*. The first Red gamma register string 241*a* may generate a gamma voltage (or a 256 gray voltage) corresponding to the received gamma reference voltage and may supply the gamma voltage to the first decoder 321.

During the above-described operation, the first Green gamma adjustment circuit 222*a* and the first Blue gamma adjustment circuit 223*a* may be maintained in an off state. The timing controller may turn on the first gamma switch 231 and may turn off the second gamma switch 232 and the third gamma switch 233. In addition, the timing controller may turn off the first connection switch 235 and the second connection switch 236.

In the first screen display configuration, the first Red gamma control register 211*a* may transmit, to the first Red gamma adjustment circuit 221*a* in the first analog gamma block 220*a*, a second gamma setting value (e.g., the Red gamma setting value corresponding to the Green gamma setting value; this setting value is obtained by mapping between the Green gamma curve and the Red gamma curve). The first Red gamma adjustment circuit 221*a* may generate a gamma reference voltage corresponding to the received second gamma setting value and may provide the gamma reference voltage to the first Green gamma register string 242*a*. The first Green gamma register string 242*a* may generate a gamma voltage corresponding to the received gamma reference voltage and may supply the gamma voltage to the second decoder 322.

During the above-described operation, the first Green gamma adjustment circuit 222*a* and the first Blue gamma adjustment circuit 223*a* may be maintained in an off state. In addition, the timing controller may turn on the first gamma switch 231 and the first connection switch 235. The timing controller may turn off the second gamma switch 232, the third gamma switch 233, and the second connection switch 236.

In the first screen display configuration, the first Red gamma control register 211*a* may transmit, to the first Red gamma adjustment circuit 221*a* in the first analog gamma block (or circuitry) 220*a*, a third gamma setting value (e.g., the Red gamma setting value corresponding to the Blue gamma setting value; this setting value is obtained by mapping between the Blue gamma curve and the Red gamma curve). The first Red gamma adjustment circuit 221*a* may generate a gamma reference voltage (or a gamma tap voltage) corresponding to the received third gamma setting value and may provide the gamma reference voltage (or the gamma tap voltage) to the first Blue gamma register string 243*a*. The first Blue gamma register string 243*a* may generate a gamma voltage corresponding to the received gamma reference voltage (or a gamma tap voltage) and may supply the gamma voltage (e.g., 256 gray scales voltage) to the third decoder 323.

During the above-described operation, the first Green gamma adjustment circuit 222*a* and the first Blue gamma adjustment circuit 223*a* may be maintained in an off state. In addition, the timing controller may turn on the first connection switch 231 and the second connection switch 236. The timing controller may turn off the second gamma switch 232, the third gamma switch 233, and the first connection switch 235.

In the first screen digital configuration, the first analog gamma block 220*a* may share a gamma reference voltage (e.g., a gamma tap voltage generated based on the Red gamma setting value) corresponding to a specified sub-pixel. For example, the gamma voltage output through the first Red gamma register string 241*a* may be supplied to an output terminal of the first green gamma register string and an input terminal of the first Blue gamma register string 243*a*. In this connection, the first analog gamma block 220*a* may generate a gamma voltage corresponding to a specified sub-pixel and supply the gamma voltage to the first decoder 321, during a first period (e.g., Hsync period). The first analog gamma block 220*a* may supply a gamma voltage, which is generated through the first Red gamma adjustment circuit 221*a* and the first Red gamma register string 241*a*, to the second decoder 322 through the input terminal of the first Green gamma register string, during a second period (e.g. an Hsync period following the first period). The first analog gamma block 220*a* may supply the gamma voltage, which is generated through the first Red gamma adjustment circuit 221*a* and the first Red gamma register string 241*a*, to the third decoder 323 through the output terminal of the first Blue gamma register string 243*a*, during a next third period (e.g. an Hsync period following the second period).

The first analog gamma block 220*a* may generate a gamma voltage corresponding to a specified sub-pixel (e.g. Red or Blue) and may supply the gamma voltage to a decoder (e.g., the first decoder or the third decoder) specified in a time-division manner, in the first screen digital configuration. A signal supplied by the decoder is supplied to a specified source amplifier (e.g., the first source amplifier or the third source amplifier). The source amplifier may supply output signals to sub-pixels using share switches described above.

The logic circuit 202 may supply, to the first to third decoders 321, 322, and 323 disposed for the respective first to third source amplifiers 311, 312, and 313, display data to be supplied to respective stripe source lines Source n, Source n+1, . . . , and Source n+n.

The timing controller (or the processor 140) may supply signals to RGB sub-pixels of the display panel 160 using the first source amplifier 311 in the first screen display configuration. During this period, the processor 140 may turn off the second source amplifier 312 and the third source amplifier 31.3. For example, the timing controller may activate the first switch 301 and supply the output of the first source amplifier 311 to the first source line Source n during the first period (e.g., an Hsync period). The first share switch 304 and the second share switch 305 may be in an off state during the first period. The timing controller may activate the first switch 301 and the second share switch 305 and supply the output of the first source amplifier 311 to the second source line Source n+1, during the second period (i.e., an Hsync period following the first period). The timing controller may activate the third share switch 306 and supply the output of the first source amplifier 311 to the third source line Source n+2, during the third period (i.e., an Hsync period following the second period).

When the first source driver 206*a* operates to share the output of the second source amplifier 312, the second share switch 305 is turned on during the first period, the first to third share switches 304, 305, and 306 are turned off during the second period, and the third share switch 306 may be turned on during the third period. During the above operation, the first gamma generator 208*a* may supply only one gamma voltage, which corresponds to a sub-pixel specified using some elements, to one source amplifier in a time-division manner. As the output of one source amplifier is shared between other source channels, the display panel 160 may provide the first screen display configuration. As described above, the first screen display configuration may be a condition to output an object (e.g., a clock object, etc.) having a mono-color or a specified number of colors, or a display condition that does not require many colors due to lower brightness. Accordingly, even if a screen is implemented through the above-described operation, the electronic device 100 provides a screen having a specific image quality or more, without degrading the image quality.

As described above, the electronic device 100 may reduce power consumption of the first gamma generator 208*a* and provide screen quality having a specific level in the display panel 160 having the stripe layout type.

Figure 3B:
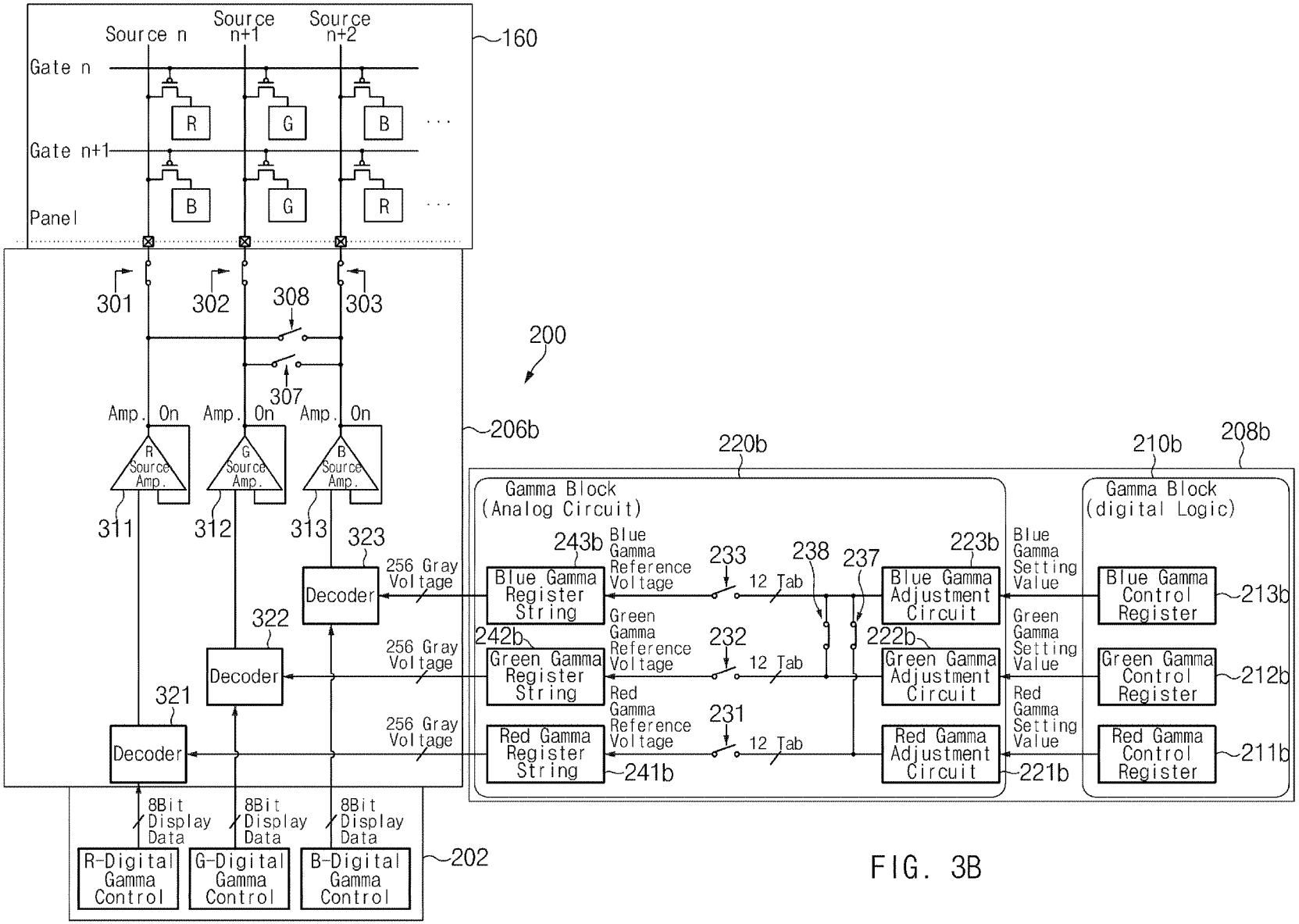
FIG. 3B is a schematic diagram illustrating an electronic device including a display panel, according to an embodiment.

FIG. 3B is a schematic diagram illustrating an electronic device including a display panel, according to an embodiment.

Referring to FIG. 3B, the electronic device 100 includes the display panel 160 having a stripe layout type and a DDI 200, which includes a second source driver 206*b*, a second gamma generator 208*b*, and a logic circuit 202. The electronic device 100 illustrated in FIG. 3B includes elements that are substantially the same as or similar to the elements illustrated in FIG. 3A, except for the second source driver 206*b* and the second gamma generator 208*b*.

The second source driver 206*b* includes a first source amplifier 311, a second source amplifier 312, a third source amplifier 313, a first decoder 321, a second decoder 322, and a third decoder 323. The second source driver 206*b* includes a fourth share switch 307, which connects an output terminal of the first source amplifier 311 with an output terminal of the second source amplifier 312, and a fifth share switch 308, which connects the output terminal of the first source amplifier 311 with an output terminal of the third source amplifier 311. In addition, the second source driver 206*b* includes a first switch 301 connected to the output terminal of the first amplifier 311, a second switch 302 connected to the output terminal of the second source amplifier 312, and a third switch 303 connected to the output terminal of the third source amplifier 313. Alternatively, the second source driver 206*b* may omit the share switches 307 and 308.

In the first screen digital configuration, the timing controller may turn on the first switch 301 and turn off a third connection switch 237 and a fourth connection switch 238 to supply the output of the first source amplifier 311 to the first source line Source n, during a first period (e.g., an Hsync period). In the first screen digital configuration, the timing controller may turn on the second switch 302 and the third connection switch 237 and turn off the first switch 301 and the fourth connection switch 238 in order to supply the output of the second source amplifier 312 to the second source line Source n+1 during the second period.

In the first screen digital configuration, the timing controller may turn on the third switch 303 and the fourth connection switch 238, and turn off the first switch 301 and the third connection switch 237 in order to supply the output of the third source amplifier 313 to the third source line Source n+2.

During the above-described operation, the second gamma generator 208*b* may generate a specified gamma voltage (e.g., 256 gray voltage or 256 gray scales voltage) using some elements (e.g., circuits generating a gamma voltage corresponding to a Blue sub-pixel) and supply the generated gamma voltage to the third decoder 323 included in the second source driver 206*b* sequentially or in the time-division manner.

The second gamma generator 208*b* includes a second digital gamma block (or circuitry) 210*b* and a second analog gamma block (or circuitry) 220*b*.

The second digital gamma block 210*b* includes gamma registers (i.e., a second Red gamma control register 211*b*, a second Green gamma control register 212*b*, and a second Blue gamma control register 213*b*). The second digital gamma block 210*b* may transmit a first gamma setting value (e.g., a Blue gamma setting value obtained by mapping a Red gamma setting value to a Blue gamma curve) having a color, which is specified by the second Blue gamma control register 213*b*, to the second analog gamma block 220*b* (i.e., a second Blue gamma adjustment circuit 223*b*) during a first period (e.g., an Hsync period to supply a signal to a Red sub-pixel) in the first screen display configuration. The second digital gamma block 210*b* may transmit a second gamma setting value (e.g., a Blue gamma setting value obtained by mapping a Green gamma setting value to a Blue gamma curve) having a color, which is specified by the second Blue gamma control register 213*b*, to the second analog gamma block 220*b* (i.e., the second Blue gamma adjustment circuit 223*b*) during a second period (e.g., a Hsync period to supply a signal to a Green sub-pixel). In addition, the second digital gamma block 210*b* may transmit a third gamma setting value (e.g., a Blue gamma setting value) having a color, which is specified by the second Blue gamma control register 213*b*, to the second analog gamma block 220*b* (i.e., the second Blue gamma adjustment circuit 223*b*) during a third period (e.g., an Hsync period to supply a signal to a Blue sub-pixel).

In the second digital gamma block 210*b*, the gamma control registers (i.e., the second Red gamma control register 211*b*, the second Green gamma control register 211*b*, and the second Blue gamma control register 211*b*) may transmit, to gamma adjustment circuits (i.e., a second Red gamma adjustment circuit 221*b*, a second Green gamma adjustment circuit 222*b*, and a second Blue gamma adjustment circuit 223*b*) in the second analog gamma block 220*b*, gamma setting values (e.g., a Red gamma setting value, a Green gamma setting value, and a Blue gamma setting value) having relevant colors in the second screen display configuration.

The second analog gamma block 220*b* includes the gamma adjustment circuits (i.e., the second Red gamma adjustment circuit 221*b*, the second Green gamma adjustment circuit 222*b*, and the second Blue gamma adjustment circuit 223*b*) and gamma voltage output circuits (or gamma register strings, i.e., a second Red gamma register string 241*b*, a second Green gamma register string 242*b*, and a second Blue gamma register string 243*b*).

The second analog gamma block 220*b* includes a first gamma switch 231 interposed between the second Red gamma adjustment circuit 221*b* and the second Red gamma register string 241*b*, a second gamma switch 232 interposed between the second Green gamma adjustment circuit 222*b* and the second Green gamma register string 242*b*, a third gamma switch 233 interposed between the second Blue gamma adjustment circuit 223*b* and the second Blue gamma register string 243*b*, a third connection switch 237 interposed between the second Blue gamma adjustment circuit 223*b* and the second Red gamma register string 241*b*, and a fourth connection switch 238 interposed between the second Blue gamma adjustment circuit 223*b* and the second Green gamma register string 242*b*. The third gamma switch 233 may be interposed between the second Blue gamma adjustment circuit 223*b* and the fourth connection switch 238.

The timing controller (or the processor 140) may turn on the third connection switch 237 and the first gamma switch 231 and turn off the second gamma switch 232, the third gamma switch 233, and the fourth connection switch 238 during the first period in the first display screen configuration. Accordingly, a first gamma reference voltage of the second Blue gamma adjustment circuit 223*b* may be transmitted to the second Red gamma register string 241*b*. The second Red gamma register string 241*b* may supply a gamma voltage (e.g., 256 gray voltage) corresponding to the first gamma reference voltage to the first decoder 321.

The timing controller may turn on the fourth connection switch 238 and the second gamma switch 232 and turn off the first gamma switch 231, the third gamma switch 233, and the third connection switch 237 during the second period in the first display screen configuration. Accordingly, a second gamma reference voltage of the second Blue gamma adjustment circuit 223*b* may be transmitted to the second Green gamma register string 242*b*. The second Green gamma register string 242*b* may generate a gamma voltage corresponding to the second gamma reference voltage and supply the generated gamma voltage (e.g., 256 gray voltage) to the second decoder 322.

The timing controller may turn on the third gamma switch 233 and turn off the first gamma switch 231, the second gamma switch 232, the third connection switch 237, and the fourth connection switch 238 during the third period in the first display screen configuration state. Accordingly, a third gamma reference voltage of the second Blue gamma adjustment circuit 223*b* may be transmitted to the second Blue gamma register string 243*b*. The second Blue gamma register string 243*b* may generate a gamma voltage (e.g., 256 gray voltage) corresponding to the third gamma reference voltage and may supply the gamma voltage to the third decoder 323.

Figure 4:
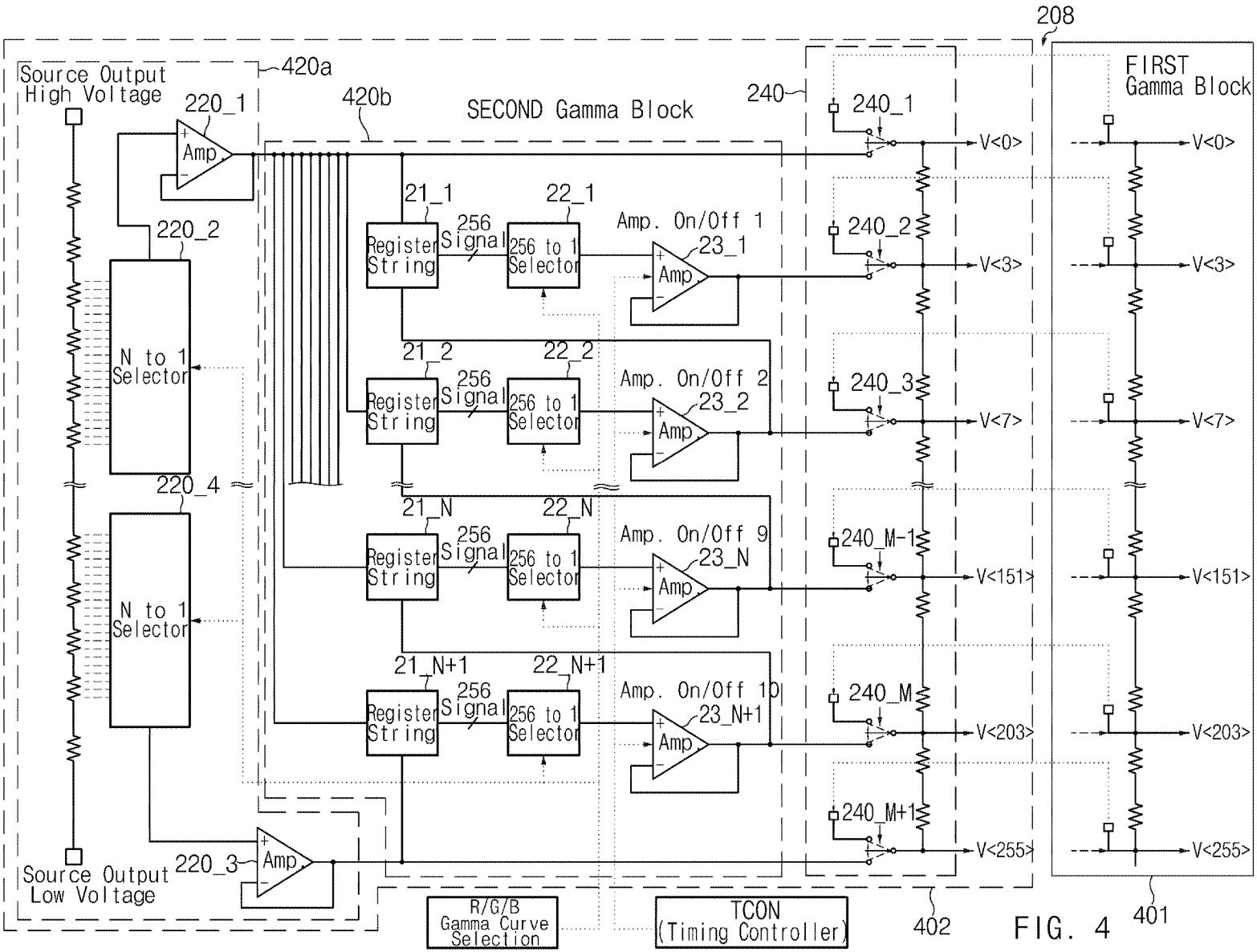
FIG. 4 is a schematic diagram illustrating a gamma generator, according to an embodiment.

FIG. 4 is a schematic diagram illustrating a gamma generator, according to an embodiment.

Referring to FIG. 4 is a gamma generator 208 includes a first gamma block 401 and a second gamma block 402. The second gamma block 402 may include two or three gamma blocks (e.g., a Red gamma block and a Green gamma block for a stripe layout type or the Red gamma block, the first Green gamma block, and the second Green gamma block for a pentile layout type) according to the types of the display panels.

The first gamma block 401 may include at least one gamma adjustment circuit and at least one gamma register string. In FIG. 4, the first gamma block 401 includes an output terminal of an analog gamma block corresponding to a first sub-pixel (e.g., a Blue sub-pixel). If a gamma reference voltage (or a gamma tap voltage) is received from the gamma adjustment circuit, the first gamma block 401 may generate a gamma voltage corresponding to the gamma reference voltage and may transmit the gamma reference voltage (or the gamma tap voltage) to the second gamma block 402 connected with a specified signal line. The above operation may be performed when a source signal is to be supplied to a sub-pixel (e.g., a Red or Green sub-pixel) corresponding to the second gamma block 402.

The second gamma block 402 includes a gamma adjustment circuit 420*a*, a gamma register string 420*b*, and a gamma output terminal 240. The gamma adjustment circuit 420*a* includes a first amplifier 220_1, a first selector 220_2, a second amplifier 220_3, and a second selector 220_4. The gamma adjustment circuit 420*a* may generate a select voltage corresponding to a gamma setting value, which is received from an R/G/B gamma curve select register (or a digital gamma block), using the first selector 220_2 or the second selector 220_4, depending on the gamma setting value, amplify the generated select voltage using the first amplifier 220_1 or the second amplifier 220_3, and then transmit the amplified result to the gamma register string 420*b*. The gamma register string 420*b* includes first to $N+1^{th}$ register strings 21_1, 21_2, . . . , 21_N, and 21_N+1, first to $N+1^{th}$ selector 22_1, 22_2, . . . , 22_N, and 22_N+1, and first to $N+1^{th}$ amplifiers 23_1, 23_2, . . . , 23_N, and 23_N+1. The gamma output terminal 240 includes first to $M+1^{th}$ switches 240_1, 240_2, 230_3, . . . , 240_M−1, 240_M, and 240_M+1. The first to $M+1^{th}$ switches 240_1, 240_2, 230_3, . . . , 240_M−1, 240_M, and 240_M+1 may be connected with an output terminal of the first gamma block 401.

At least a part of the gamma adjustment circuit 420*a* and the gamma register string 420*b* included in the second gamma block 402 may be controlled to be unusable in the first screen display configuration. For example, the timing controller may turn off at least some of the first amplifier 220_1 and the second amplifier 220_3, which are included in the gamma adjustment circuit 420*a*, and the first to $N+1^{th}$ amplifiers 23_1, 23_2, . . . , 23_N, and 23_N+1 included in the gamma register string 420*b* included in the gamma block 402. The timing controller may control a gamma tap voltage, which corresponds to specified gray scale, to be an output corresponding to the gray scale of the second gamma block 402. Accordingly, the second gamma block 402 may supply a specified gamma voltage to a decoder, which corresponds to the second gamma block 402, even if only a switching operation of the gamma output terminal 240 is performed.

For example, the first gamma block 401 may be a Blue gamma block, and the second gamma block 402 may be a Red gamma block or a Green gamma block. In addition, as described above, the first gamma block 401 may be a Red gamma block, and the second gamma block 402 may be a Blue gamma block or a Green gamma block.

Although the various descriptions above have referenced the gamma reference voltage (or a gamma tap voltage) being shared based on the arrangement of sub-pixels in an RGB stripe layout structure, the present disclosure is not limited thereto. For example, the sharing structure for the gamma tap voltage according to an embodiment of the present disclosure may be identically applied to the arrangement of sub-pixels in an RGBG or RGGB pentile layout structure. In this connection, the gamma generator may be designed to include four gamma blocks and to commonly employ a gamma tap voltage of a gamma block (e.g., a Blue gamma block), which corresponds to a specified sub-pixel, among the four gamma blocks as outputs of remaining three gamma blocks.

Figure 5:
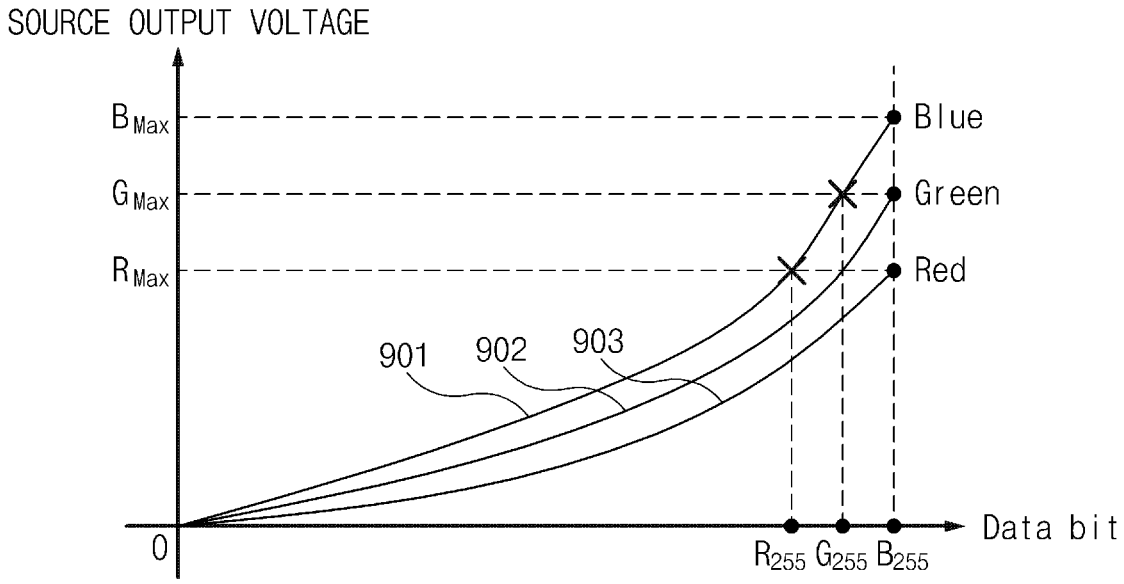
FIG. 5 illustrates output of a digital gamma value, according to an embodiment.

FIG. 5 illustrates output of a digital gamma value, according to an embodiment.

Referring to FIG. 5, gamma value curves according to colors are illustrated in the form of a graph, which includes the gamma value curves associated with the colors. A first curve 901 includes a gamma value curve associated with a Blue color, a second curve 902 includes a gamma value curve associated with a Green color, and a third curve 903 includes a gamma value curve associated with a Red color. A right end point of the first curve 901 includes a gray scale value of 255 of the relevant color. The shapes of the curves or the sequence of illustrating the curves may vary depending on the physical characteristics of sub-pixels applied to a display panel. For example, although the gamma value curve associated with the Blue color is illustrated as representing the highest source output voltage, the gamma value curve associated with the Red color may be disposed at the highest position according to the compositions of materials constituting the sub-pixels. In this case, the first curve 901 may include the gamma value curve associated with the Red color. The second curve 902 may include the gamma value curve associated with the Green color and the third curve 903 may include the gamma value curve associated with the Blue color.

As described above, in an electronic device according to an embodiment of the present disclosure, the gamma voltage for the sub-pixel of a color, which represents the widest gamma output voltage scope, among Red, Green, and Blue sub-pixels depending on the characteristic of the display panel may be substituted for the gamma voltages for sub-pixels of remaining colors.

A processor of an electronic device may control a gamma generator to generate an analog gamma value depending on the above gamma value curves and may deactivate some elements (e.g., at least one of the gamma adjustment circuits and the gamma register strings) of the gamma generator. For example, the processor may calculate Red and Green digital gamma values using the gamma value curve associated with the Blue color, may set a Blue gamma value corresponding to a source output voltage GMax to the maximum gray scale (e.g., G255) of a Green color, may divide the Blue gamma curve from an original point to a point of G255 into 255, and may calculate a digital gamma value (a Blue gamma setting value corresponding to a Green gamma setting value). In this case, the processor may minimize the distortion of a gamma value by using gray scale values of 0 to 254 without using the value at the G255 corresponding to the source output voltage GMax.

Similarly, the processor may set a Blue gamma value corresponding to a source output voltage RMax to the maximum gray scale (e.g., G255) of a Red color, may divide the Blue gamma curve from the original point to a point of R255 into 255, and may calculate a digital gamma value (a Blue gamma setting value corresponding to a Red gamma setting value) associated with the Red color. The processor may uniformly (or irregularly) divide a section, which ranges from the original point to the point of the RMax or to the GMax, into 255 along the vertical axis and may map a gray scale value to each divided part.

As described above, in relation to the operation of the gamma voltage according to an embodiment of the present disclosure, in a display structure having gamma circuit devices (or circuit elements) separated according to sub-pixels, at least some of circuit devices (e.g., amplifiers) that generate the gamma voltage are turned off, depending on the display configuration, and the gamma voltage for a specified sub-pixel is shared, such that the image quality is maintained at or above a specified quality. That is, a processor of an electronic device may map a gamma setting value to a gamma curve of the specified sub-pixel based on the relation between the above gamma curves, thereby changing the display data in match with target coordinates.

According to an embodiment of the present disclosure, an electronic device may include a display panel and a display driver integrated circuit, wherein the display driver integrated circuit includes a source driver including source amplifiers configured to amplify output signals to be output through one or more sub-pixels included in each pixel of the display panel, a gamma voltage output circuit configured to output one or more gamma voltages for correcting (or compensating) gray scales of the output signals depending on characteristics of the one or more sub-pixels, a gamma adjustment circuit configured to provide one or more reference voltages (or) to the gamma voltage output circuit and including one or more signal lines connected with the gamma voltage output circuit, and one or more connection switches connected between the one or more signal lines.

The gamma adjustment circuit may be configured to provide the reference voltages (or a gamma tap voltage) for one sub-pixel of the one or more sub-pixels as a reference voltages (a gamma tap voltage) for another sub-pixel of the one or more sub-pixels, if a brightness value of the output signals is in a first brightness range, and provide a reference voltage (or a gamma tap voltage) corresponding to each of the one or more sub-pixels to the gamma voltage output circuit, if the brightness value of the output signals is in a second brightness range.

According to an embodiment of the present disclosure, an electronic device may include a display panel including a plurality of source channels and a display driver integrated circuit associated with display panel driving, wherein the display driver integrated circuit includes a source driver including source amplifiers configured to supply signals to the source channels, respectively, and decoders connected with input terminals of the source amplifiers, respectively, a gamma generator configured to supply a gamma voltage to the source driver, and a timing controller configured to control gamma voltage generation of the gamma generator, and wherein the gamma generator includes circuit devices (or circuit elements) for sub-pixels, configured to supply gamma voltages to the decoders and at least one connection switch configured to selectively connect a circuit device, which is configured to supply a gamma voltage to a specified decoder among the decoders, with a circuit device configured to supply a gamma voltage to another decoder among the decoders in response to a control signal.

The circuit devices (or circuit elements) for the sub-pixels may include a digital gamma block configured to supply a gamma setting value of a specified sub-pixel among the sub-pixels in a first screen display configuration and to supply a gamma setting value of each of the sub-pixels in a second screen display configuration different from the first screen display configuration and an analog gamma block configured to generate the gamma tap voltages based on the gamma setting value received from the digital gamma block and to supply a gamma voltage corresponding to the generated gamma tap voltages to the decoders, respectively.

The first screen display configuration includes lower-brightness screen display configuration for driving the display panel with less than specified brightness and wherein the second screen display configuration includes higher-brightness screen display configuration for driving the display panel brightness with equal to or higher than the specified brightness.

The analog gamma block includes gamma adjustment circuits configured to generate gamma reference voltages corresponding to the sub-pixels, respectively, based on gamma setting values and gamma register strings configured to generate the gamma voltages based on the gamma reference voltages.

The at least one connection switch is interposed between a gamma adjustment circuit, which corresponds to the specified sub-pixel, among the gamma adjustment circuits and a gamma register string, which corresponds to another sub-pixel, among the gamma register strings.

The analog gamma block includes a first gamma adjustment circuit configured to generate a gamma reference voltage based on a gamma setting value corresponding to a blue sub-pixel, a second gamma adjustment circuit configured to generate a gamma reference voltage based on a gamma setting value corresponding to at least one green sub-pixel, a third gamma adjustment circuit configured to generate a gamma reference voltage based on a gamma setting value corresponding to a red sub-pixel, a first gamma register string configured to supply a gamma voltage corresponding to the blue sub-pixel, based on an output of the first gamma adjustment circuit, a second gamma register string configured to supply a gamma voltage corresponding to the at least one green sub-pixel, based on an output of the second gamma adjustment circuit, a third gamma register string configured to supply a gamma voltage corresponding to the red sub-pixel, based on an output of the third gamma adjustment circuit, a first connection switch interposed between an output terminal of the first gamma adjustment circuit and an input terminal of the third gamma register string, and a second connection switch interposed between an output terminal of the first gamma adjustment circuit and an input terminal of the second gamma register string.

The circuit devices (or circuit elements) for the sub-pixels include a digital gamma block configured to calculate a gamma setting value of a specified sub-pixel, which corresponds to a gamma setting value of another sub-pixel, based on a gamma curve of the specified sub-pixel in a first screen display configuration for driving the display panel with less than specified brightness, and to supply the calculated gamma setting value and an analog gamma block configured to generate the gamma tap voltages based on the gamma setting value received from the digital gamma block and to supply a gamma voltage corresponding to the generated gamma tap voltages to the decoders, respectively.

The timing controller is configured to receive a control signal associated with a screen display configuration of the display panel and generate the gamma voltage using some circuit devices among the circuit devices (or circuit elements) for the sub-pixels and supply the generated gamma voltage to the sub-pixels in a time-division manner, if the control signal is a control signal to instruct that the display panel is displayed with less than specified brightness.

The timing controller is configured to turn off remaining circuit devices of the circuit devices (or circuit elements), other than the circuit devices associated with the generation of the gamma voltage.

Figure 6A:
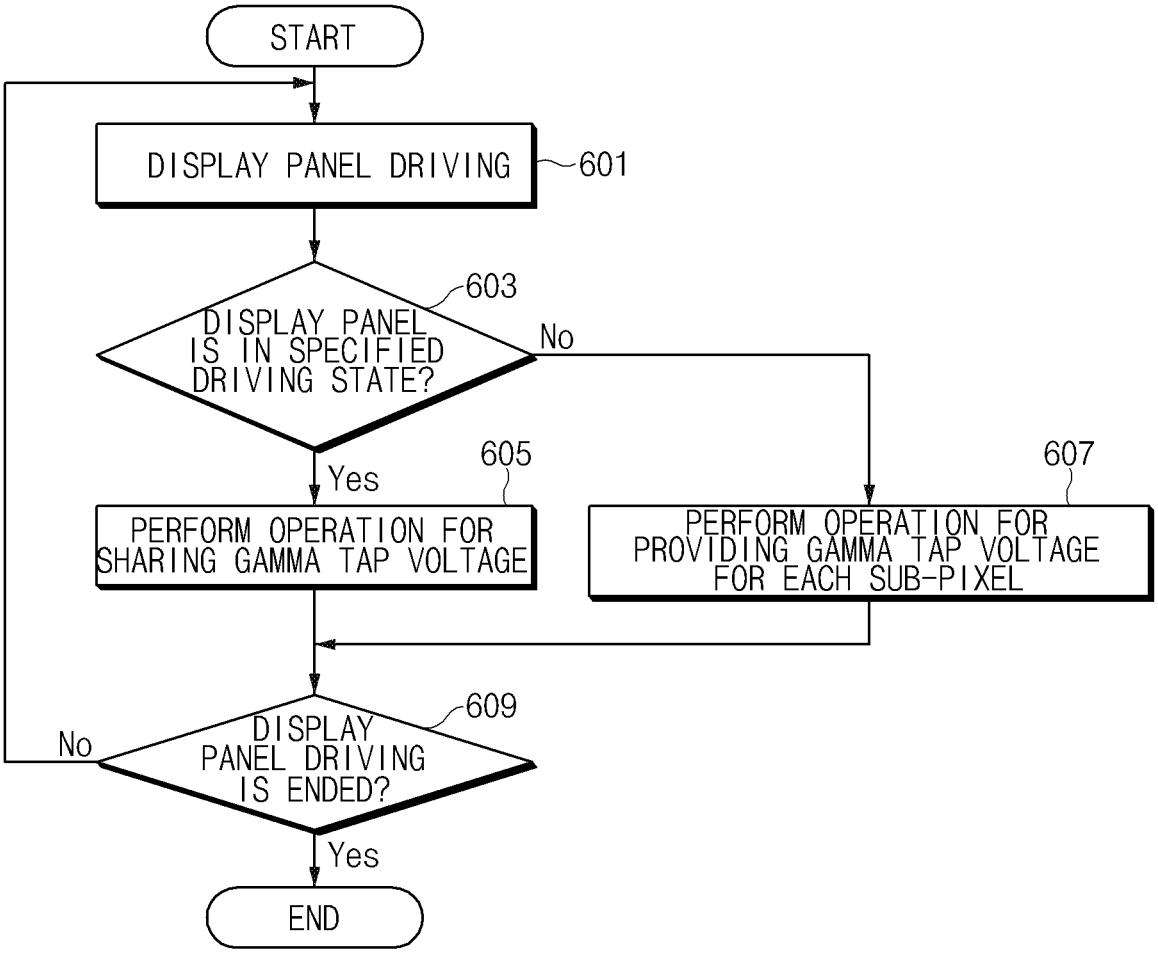
FIG. 6A is a flowchart illustrating an operating method of an electronic device using a gamma voltage corresponding to a display configuration, according to an embodiment.

FIG. 6A is a flowchart illustrating an operating method of an electronic device using a gamma voltage corresponding to a display configuration, according to an embodiment.

Referring to FIG. 6A, in step 601, a processor (or a DDI or logic circuit) of an electronic device performs display panel driving depending on a user input or a display configuration.

In step 603, the processor determines whether the display panel is in a specified driving state, e.g., a first screen display configuration (the state to drive the display panel to have brightness less than specified intensity). Alternatively, the driving state of the display panel may be determined by the DDI. For example, the DDI may determine the value to indicate the driving state of the display panel while displaying an image on the display panel. Accordingly, the DDI may include a memory area or a register in which the value to indicate the driving state of the display panel is recoded.

If a display configuration for a specified driving state is present or a user input to request for the specified driving state is received, the processor performs an operation for sharing a gamma tap voltage (or a gamma reference voltage, or a gamma voltage) in step 605. For example, the processor may provide a control signal associated with sharing a gamma tap voltage to a timing controller included in the DDI. The timing controller may perform a control operation such that a gamma tap voltage of a gamma adjustment circuit corresponding to a specified sub-pixel is supplied to gamma register strings corresponding to other sub-pixels. In addition, the timing controller may supply the output of the gamma register string (e.g., a Blue gamma register string) corresponding to the specified sub-pixel to an output terminal of a gamma register string (e.g., a gamma register string corresponding to a Red sub-pixel or a Green sub-pixel) corresponding to another sub-pixel. The gamma voltage (e.g., 256 gray scales voltage) of output terminal of each gamma register string may be supplied to a decoder corresponding to the relevant sub-pixel. The user input to request for the specified driving state may be received by the processor and then transmitted to the DDI. In addition, the DDI may include an additional signal line to receive a user input signal associated with the specified driving state and may receive a signal, which is associated with a driving state of the display panel, through the signal line. Alternatively, a button to generate a user input signal may be directly connected with the DDI.

If the display configuration for the specified driving state is absent or the driving of the display panel according to the execution of a general function is requested in step 603, the processor performs a control operation to generate gamma voltages using all of the circuit devices included in the gamma generator and to supply the generated gamma voltages to the relevant decoders in step 607. For example, a gamma setting value corresponding to a first sub-pixel (e.g., a Red sub-pixel) is supplied to a first gamma adjustment circuit corresponding to the first sub-pixel and a first gamma tap voltage output from the first gamma adjustment circuit may be supplied to a first decoder through a first gamma register string. A gamma setting value corresponding to a second sub-pixel (e.g., a Green sub-pixel) is supplied to a second gamma adjustment circuit corresponding to the second sub-pixel and a second gamma tap voltage output from the second gamma adjustment circuit may be supplied to a second decoder through a second gamma register string. A gamma setting value corresponding to a third sub-pixel (e.g., a Blue sub-pixel) is supplied to a third gamma adjustment circuit corresponding to the third sub-pixel and a third gamma tap voltage output from the third gamma adjustment circuit may be supplied to a third decoder through a third gamma register string.

In step 609, the processor determines whether an input event associated with the ending of display panel driving occurs or a schedule associated with the ending of the display panel driving arrives. If the input event associated with the ending of display panel driving does not occur or the schedule associated with the ending of the display panel driving does not arrive, the operating method returns to step 601. However, if the input event associated with the ending of display panel driving occurs in step 609, the processor ends the display panel driving.

Figure 6B:
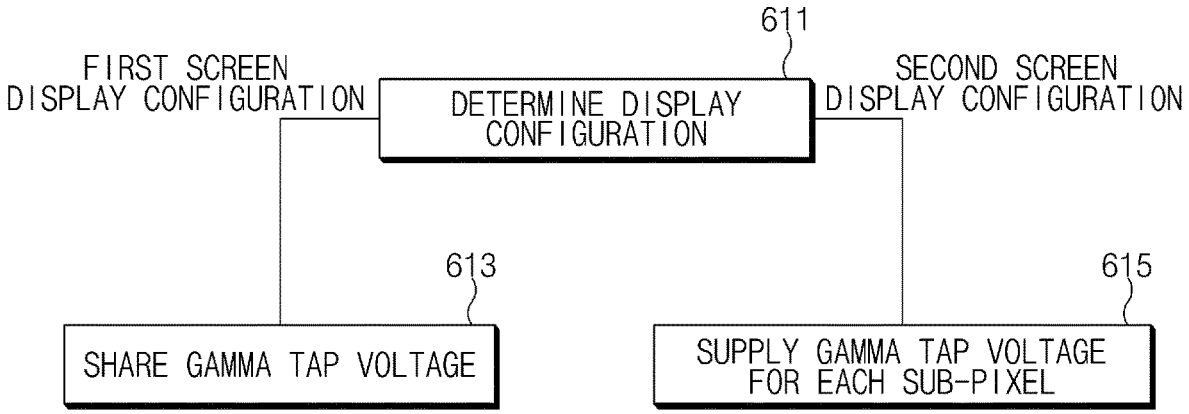
FIG. 6B is a flowchart illustrating an operating method of an electronic device using a gamma voltage corresponding to a display configuration, according to an embodiment.

FIG. 6B is a flowchart illustrating an operating method of an electronic device using a gamma voltage corresponding to a display configuration, according to an embodiment.

Referring to FIG. 6B, in step 611, a processor (or a DDI) determines a screen display configuration of a display panel. The screen display configuration may be determined by receiving a user input signal associated with screen display configuration or determining the screen display configuration of an application under execution.

When the determined screen display configuration is a first screen display configuration in step 611, the processor (or the DDI) supplies a gamma tap voltage for each sub-pixel using some of the circuit devices according to sub-pixels, which supply gamma tap voltages to a plurality of source channels, in step 613. For example, the processor may use a gamma tap voltage of a Blue sub-pixel as a gamma tap voltage of a Red sub-pixel or a Green sub-pixel.

However, if the determined screen display configuration is a second screen display configuration in step 611, the processor (or the DDI) supplies gamma tap voltages to sub-pixels using circuit devices for the sub-pixels that are used to supply the gamma tap voltages to the source channels in step 615. For example, the processor may process the gamma tap voltages of respective RGB (or RGGB) pixels as outputs of gamma blocks associated with the respective RGB (or RGGB) pixels.

According to an embodiment of the present disclosure, an operating method of an electronic device using a gamma voltage of a display panel including a plurality of channels may include determining a screen display configuration of the display panel, supplying gamma voltages to sub-pixels by using some circuit devices among circuit devices for the sub-pixels, which supply the gamma voltages to the source channels, if the screen display configuration is a specified first screen display configuration, and supplying gamma voltages to the sub-pixels by using the circuit devices for the sub-pixels, which supply the gamma voltages to the source channels, if the screen display configuration is a specified second screen display configuration different from the first screen display configuration.

Determining the screen display configuration includes determining at least one of a configuration for driving the display panel with brightness less than specified brightness, a configuration for displaying only a specified object, and a configuration for displaying a screen in a specified color to be the first screen display configuration.

Determining the screen display configuration includes determining at least one of a configuration for driving the display panel with brightness equal to or higher than specified brightness and a configuration for displaying an execution screen of a specified application associated with reproduction of a moving picture to be the second screen display configuration.

Supplying the gamma voltages includes connecting a circuit device, which supplies a gamma voltage to a specified decoder, with a circuit device, which supplies a gamma voltage to another decoder, using a switch for sub-pixel driving duration corresponding to the another decoder in response to a control signal, in the first screen display configuration.

Supplying the gamma voltages includes generating a gamma tap voltage for each sub-pixel based on a gamma setting value of a specified sub-pixel, in the first screen display configuration.

Supplying the gamma voltages further includes calculating a gamma setting value corresponding to a gamma setting value of another sub-pixel, based on a gamma curve of the specified sub-pixel, in the first screen display configuration.

Supplying the gamma voltages further includes calculating a gamma setting value corresponding to a gamma setting value of a Red sub-pixel or a Green sub-pixel, based on a gamma curve of a Blue sub-pixel, in the first screen display configuration.

Supplying the gamma voltages includes generating a gamma tap voltage for each sub-pixel based on a gamma setting value for each sub-pixel, in the second screen display configuration.

Supplying the gamma voltages includes cutting off supplying of power to other circuit devices among the circuit devices except for the some circuit devices, in the first screen display configuration.

Figure 7:
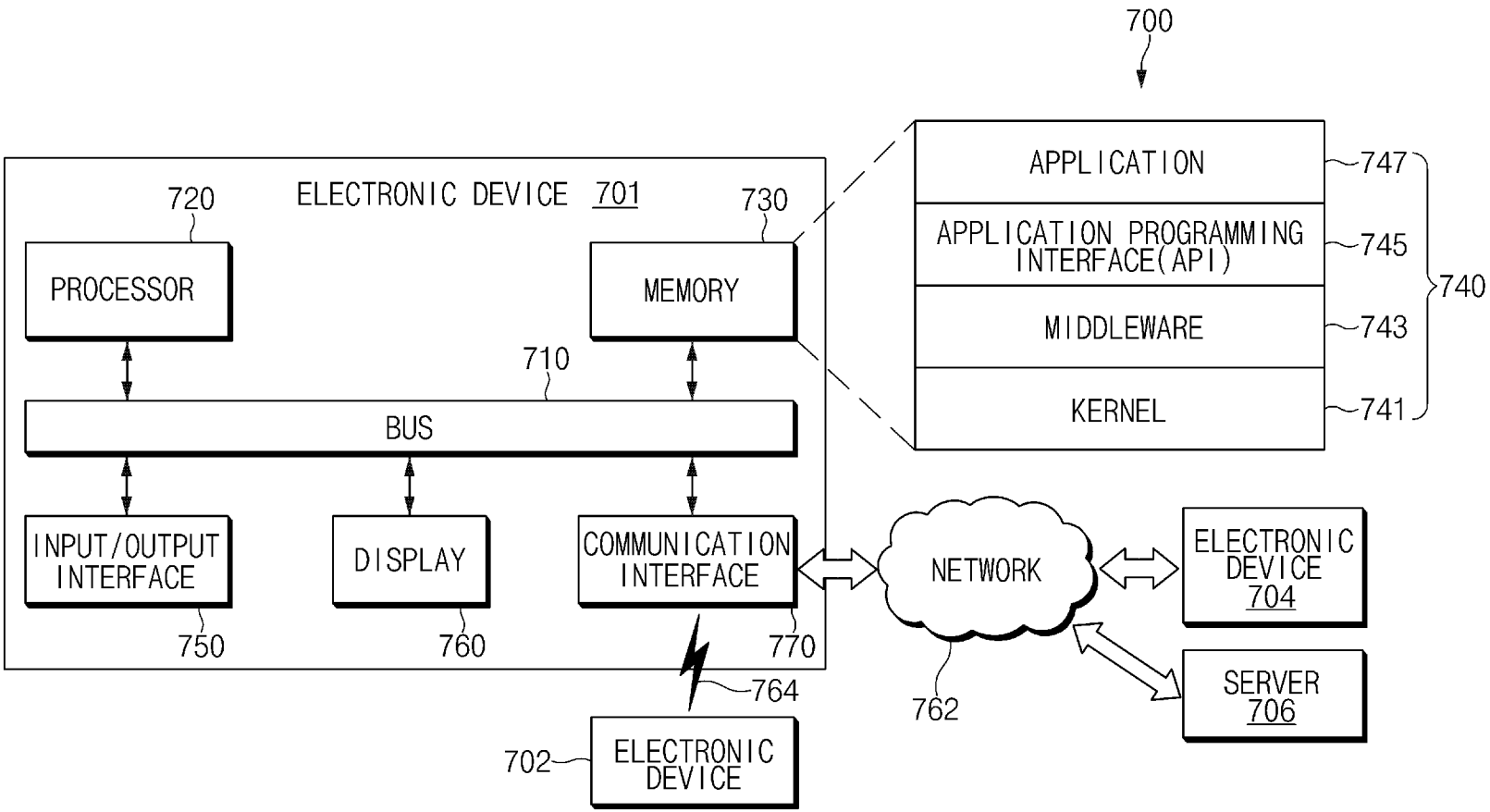
FIG. 7 illustrates an electronic device in a network environment, according to an embodiment.

FIG. 7 illustrates an electronic device in a network environment according to an embodiment.

Referring to FIG. 7, in various embodiments, an electronic device 701 and a first external electronic device 702, a second external electronic device 704, and/or a server 706 may connect with each other through a network 762 or local-area communication 764. The electronic device 701 may include a bus 710, a processor 720, a memory 730, an input and output interface 750, a display 760, and a communication interface 770. In some embodiments, at least one of the components may be omitted from the electronic device 701, or other components may be additionally included in the electronic device 701.

The bus 710 may be, for example, a circuit which connects the components 720 to 770 with each other and transmits a communication signal (e.g., a control message and/or data) between the components.

The processor 720 may include one or more of a CPU, an AP, or a communication processor (CP). For example, the processor 720 may perform calculation or data processing about control and/or communication of at least another of the components of the electronic device 701.

The memory 730 may include a volatile and/or non-volatile memory. The memory 730 may store, for example, an instruction or data associated with at least another of the components of the electronic device 701. According to an embodiment, the memory 730 may store software and/or a program 740. The program 740 may include, for example, a kernel 741, a middleware 743, an application programming interface (API) 745, at least one application program 747 (at least one application), etc. At least part of the kernel 741, the middleware 743, or the API 745 may be referred to as an operating system (OS).

The kernel 741 may control or manage, for example, system resources (e.g., the bus 710, the processor 720, the memory 730, etc.) used to execute an operation or function implemented in the other programs (e.g., the middleware 743, the API 745, or the application program 747). Also, as the middleware 743, the API 745, or the application program 747 accesses a separate component of the electronic device 701, the kernel 741 may provide an interface which may control or manage system resources.

The middleware 743 may play a role as, for example, a go-between such that the API 745 or the application program 747 communicates with the kernel 741 to communicate data.

Also, the middleware 743 may process one or more work requests, received from the application program 747, in order of priority. For example, the middleware 743 may assign priority which may use system resources (the bus 710, the processor 720, the memory 730, etc.) of the electronic device 701 to at least one of the at least one application program 747. For example, the middleware 743 may perform scheduling or load balancing for the one or more work requests by processing the one or more work requests in order of the priority assigned to the at least one of the at least one application program 747.

The API 745 may be, for example, an interface in which the application program 747 controls a function provided from the kernel 741 or the middleware 743. For example, the API 745 may include at least one interface or function (e.g., an instruction) for file control, window control, image processing, or text control, and the like.

The input and output interface 750 may play a role as, for example, an interface which may transmit an instruction or data input from a user or another external device to another component (or other components) of the electronic device 701. Also, input and output interface 750 may output an instruction or data received from another component (or other components) of the electronic device 701 to the user or the other external device.

The display 760 may include, for example, a liquid crystal display (LCD), a light emitting diode (LED) display, an organic LED (OLED) display, a microelectromechanical systems (MEMS) display, or an electronic paper display. The display 760 may display, for example, a variety of content (e.g., text, images, videos, icons, symbols, etc.) to the user. The display 760 may include a touch screen, and may receive, for example, touch, gesture, proximity, or a hovering input using an electronic pen or part of a body of the user.

The communication interface 770 may establish communication between, for example, the electronic device 701 and an external device (e.g., a first external electronic device 702, a second external electronic device 704, or a server 706). For example, the communication interface 770 may connect to a network 762 through wireless communication or wired communication and may communicate with the external device (e.g., the second external electronic device 704 or the server 706).

The wireless communication may use, for example, at least one of long term evolution (LTE), LTE-advanced (LTE-A), code division multiple access (CDMA), wideband CDMA (WCDMA), universal mobile telecommunications system (UMTS), wireless broadband (WiBro), global system for mobile communications (GSM), etc., as a cellular communication protocol. Also, the wireless communication may include, for example, local-area communication 764. The local-area communication 764 may include, for example, at least one of wireless-fidelity (Wi-Fi) communication, Bluetooth (BT) communication, near field communication (NFC), global navigation satellite system (GNSS) communication, etc.

A magnetic secure transmission (MST) module may generate a pulse based on transmission data using an electromagnetic signal and may generate a magnetic field signal based on the pulse. The electronic device 701 may output the magnetic field signal to a POS system. The POS system may restore the data by detecting the magnetic field signal using an MST reader and converting the detected magnetic field signal into an electric signal.

The GNSS may include, for example, at least one of a global positioning system (GPS), a Glonass, a Beidou navigation satellite system (Beidou), or a Galileo, the European global satellite-based navigation system according to an available area or a bandwidth. Hereinafter, the term "GPS" may be used interchangeably with the "GNSS".

The wired communication may include at least one of, for example, universal serial bus (USB) communication, high definition multimedia interface (HDMI) communication, recommended standard 232 (RS-232) communication, plain old telephone service (POTS) communication, etc. The network 762 may include a telecommunications network, for example, at least one of a computer network (e.g., a local area network (LAN) or a wide area network (WAN)), the Internet, or a telephone network.

Each of the first and second external electronic devices 702 and 704 may be the same as or different device from the electronic device 701. According to an embodiment, the server 706 may include a group of one or more servers. According to some embodiments, all or some of operations executed in the electronic device 701 may be executed in another electronic device or a plurality of electronic devices (e.g., the first external electronic device 702, the second external electronic device 704, or the server 706). According to an embodiment, if the electronic device 701 should perform any function or service automatically or according to a request, it may request another device (e.g., the first external electronic device 702, the second external electronic device 704, or the server 106) to perform at least part of the function or service, rather than executing the function or service for itself or in addition to the function or service. The other electronic device (e.g., the first external electronic device 702, the second external electronic device 704, or the server 706) may execute the requested function or the added function and may transmit the executed result to the electronic device 701. The electronic device 701 may process the received result without change or additionally and may provide the requested function or service. For this purpose, for example, cloud computing technologies, distributed computing technologies, or client-server computing technologies may be used.

The electronic device 701 may be connected with another electronic device 704 or a server 706 through a network 762 and may receive content from the another electronic device 704 or the server 706. The electronic device 701 may vary the driving frequency of a display panel depending on the characteristic of the content. For example, the electronic device 701 may receive and output a broadcast screen from an external electronic device or the server 706. In this case, the electronic device 701 may output the broadcast screen while operating at a driving frequency (e.g., 60 Hz) having a specified size or more. In this case, the DDI may supply a source signal necessary for the implementation of a screen using a connection switch in a turn-off state and source amplifiers driven in a time-division manner.

According to some embodiments, the electronic device 701 may receive a still image from the external electronic device or the server 706 and may output the still image. In this case, the electronic device 701 may output the still image while operating at a driving frequency (e.g., 30 Hz) having a specified size or more. Accordingly, the electronic device 701 may output the still image by using the connection switch in a turn-on state or in the time-division driving manner (during time-division driving, some source amplifiers is in the turn-off state) for a specified source amplifier. In the time-division manner for the source amplifier of the electronic device 701, a first period of time-division driving of a specified source amplifier at a first driving frequency (e.g., 60 Hz) may be set to be shorter than a second period of time-division driving of the specified source amplifier at a second driving frequency (e.g., 30 Hz). For example, the second period may be twice the first period. The difference between the first period and the second period may be increased in proportion to the number of turned-off source amplifiers (or the number of connection switches interposed between the specified source amplifier and other source amplified to be turned on) sharing the output of the specified source amplifier.

Figure 8:
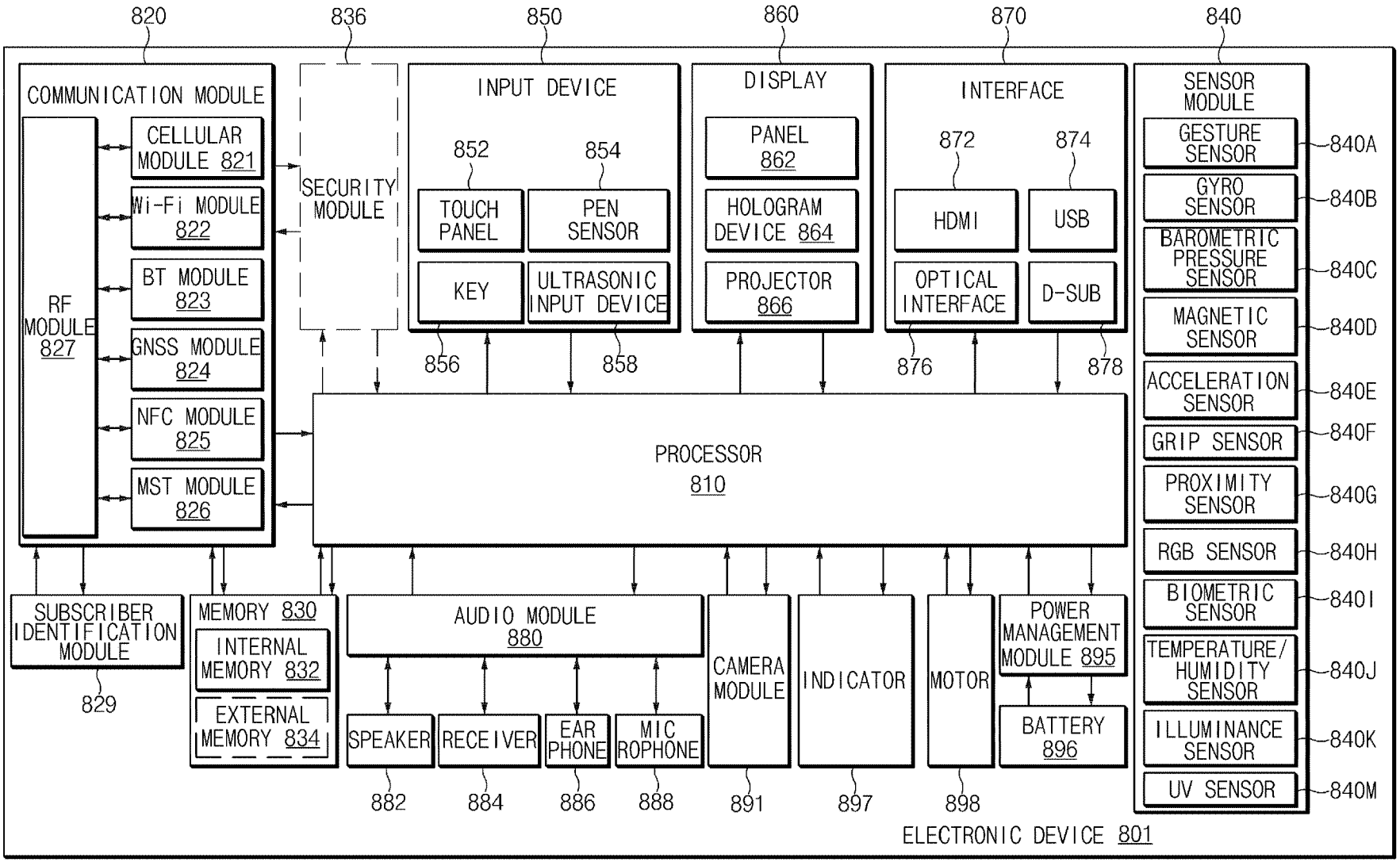
FIG. 8 illustrates an electronic device according to an embodiment.

FIG. 8 illustrates an electronic device according to an embodiment.

Referring to FIG. 8, the electronic device 801 may include, for example, all or part of an electronic device 701 shown in FIG. 7. The electronic device 801 may include one or more processors 810 (e.g., APs), a communication module 820, a subscriber identification module (SIM) 829, a memory 830, a security module 836, a sensor module 840, an input device 850, a display 860, an interface 870, an audio module 880, a camera module 891, a power management module 895, a battery 896, an indicator 897 and a motor 898.

The processor 810 may drive, for example, an operating system (OS) or an application program to control a plurality of hardware or software components connected thereto and may process and compute a variety of data. The processor 810 may be implemented with, for example, an SoC. According to an embodiment, the processor 810 may include a graphic processing unit (GPU) and/or an image signal processor. The processor 810 may include at least some (e.g., a cellular module 821) of the components shown in FIG. 8. The processor 810 may load an instruction or data received from at least one of other components (e.g., a non-volatile memory) into a volatile memory to process the data and may store various data in a non-volatile memory.

The communication module 820 may have the same or similar configuration to a communication interface 770 of FIG. 7. The communication module 820 may include, for example, the cellular module 821, a wireless fidelity (Wi-Fi) module 822, a Bluetooth (BT) module 823, a GNSS module 824 (e.g., a GPS module, a Glonass module, a Beidou module, or a Galileo module), an NFC module 825, an MST module 826, and a radio frequency (RF) module 827.

The cellular module 821 may provide, for example, a voice call service, a video call service, a text message service, an Internet service, etc., through a communication network. According to an embodiment, the cellular module 821 may identify and authenticate the electronic device 801 in a communication network using the SIM 829 (e.g., a SIM card). According to an embodiment, the cellular module 821 may perform at least part of functions which may be provided by the processor 810. According to an embodiment, the cellular module 821 may include a CP.

The Wi-Fi module 822, the BT module 823, the GNSS module 824, the NFC module 825, or the MST module 826 may include, for example, a processor for processing data transmitted and received through the corresponding module. According to various embodiments, at least some (e.g., two or more) of the cellular module 821, the Wi-Fi module 822, the BT module 823, the GNSS module 824, the NFC module 825, or the MST module 826 may be included in one IC or one IC package.

The RF module 827 may transmit and receive, for example, a communication signal (e.g., an RF signal). Though not shown, the RF module 827 may include, for example, a transceiver, a power amplifier module (PAM), a frequency filter, or a low noise amplifier (LNA), an antenna, etc. According to another embodiment, at least one of the cellular module 821, the Wi-Fi module 822, the BT module 823, the GNSS module 824, the NFC module 825, or the MST module 826 may transmit and receive an RF signal through a separate RF module.

The SIM 829 may include, for example, a card which includes a SIM and/or an embedded SIM. The SIM 829 may include unique identification information (e.g., an integrated circuit card identifier (ICCID)) or subscriber information (e.g., an international mobile subscriber identity (IMSI)).

The memory 830 (e, g, a memory 730 of FIG. 7) may include, for example, an embedded memory 832 or an external memory 834. The embedded memory 832 may include at least one of, for example, a volatile memory (e.g., a dynamic random access memory (DRAM), a static RAM (SRAM), a synchronous dynamic RAM (SDRAM), and the like), or a non-volatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory a NOR flash memory, etc.), a hard drive, or a solid state drive (SSD)).

The external memory 834 may include a flash drive, for example, a compact flash (CF), a secure digital (SD), a micro-SD, a mini-SD, an extreme digital (xD), a multimedia card (MMC), a memory stick, etc. The external memory 834 may operatively and/or physically connect with the electronic device 801 through various interfaces.

The secure module 836 may be a module which has a relatively higher secure level than the memory 830 and may be a circuit which stores secure data and guarantees a protected execution environment. The secure module 836 may be implemented with a separate circuit and may include a separate processor. The secure module 836 may include, for example, an embedded secure element (eSE) which is present in a removable smart chip or a removable SD card or is embedded in a fixed chip of the electronic device 801. Also, the secure module 836 may be driven by an OS different from the OS of the electronic device 801. For example, the secure module 836 may operate based on a Java card open platform (JCOP) OS.

The sensor module 840 may measure, for example, a physical quantity or may detect an operation state of the electronic device 801, and may convert the measured or detected information to an electric signal. The sensor module 840 may include at least one of, for example, a gesture sensor 840A, a gyro sensor 840B, a barometer sensor 840C, a magnetic sensor 840D, an acceleration sensor 840E, a grip sensor 840F, a proximity sensor 840G, a color sensor 840H (e.g., an RGB sensor), a biometric sensor 840I, a temperature/humidity sensor 840J, an illumination sensor 840K, or an ultraviolet (UV) sensor 840M. Additionally or alternatively, the sensor module 840 may further include, for example, an e-nose sensor, an electromyography (EMG) sensor, an electroencephalogram (EEG) sensor, an electrocardiogram (ECG) sensor, an infrared (IR) sensor, an iris sensor, a fingerprint sensor, etc. The sensor module 840 may further include a control circuit for controlling at least one or more sensors included therein. According to various embodiments, the electronic device 801 may further include a processor configured to control the sensor module 840, as part of the processor 810 or to be independent of the processor 810. While the processor 810 is in a sleep state, the electronic device 801 may control the sensor module 840.

The input device 850 may include, for example, a touch panel 852, a (digital) pen sensor 854, a key 856, or an ultrasonic input device 858. The touch panel 852 may use at least one of, for example, a capacitive type, a resistive type, an infrared type, or an ultrasonic type. Also, the touch panel 852 may further include a control circuit. The touch panel 852 may further include a tactile layer and may provide a tactile reaction to a user.

The (digital) pen sensor 854 may be, for example, part of the touch panel 852 or may include a separate sheet for recognition. The key 856 may include, for example, a physical button, an optical key, or a keypad. The ultrasonic input device 858 may allow the electronic device 801 to detect a sound wave using a microphone 888 and to verify data through an input tool generating an ultrasonic signal.

The display 860 may include a panel 862, a hologram device 864, or a projector 866. The panel 862 may include the same or similar configuration to the display 160 or 760. The panel 862 may be implemented to be, for example, flexible, transparent, or wearable. The panel 862 and the touch panel 852 may be integrated into one module. The hologram device 864 may show a stereoscopic image in a space using interference of light. The projector 866 may project light onto a screen to display an image. The screen may be positioned, for example, inside or outside the electronic device 801. According to an embodiment, the display 860 may further include a control circuit for controlling the panel 862, the hologram device 864, or the projector 866.

The interface 870 may include, for example, an HDMI 872, a USB 874, an optical interface 876, or a D-subminiature 878. The interface 870 may be included in, for example, a communication interface 170 or 770 shown in FIG. 2 or 7. Additionally or alternatively, the interface 870 may include, for example, a mobile high definition link (MHL) interface, an SD/MMC interface, or an Infrared Data Association (IrDA) standard interface.

The audio module 880 may convert a sound and an electric signal in dual directions. At least part of components of the audio module 880 may be included in, for example, an input and output interface 750 (or a user interface) shown in FIG. 7. The audio module 880 may process sound information input or output through, for example, a speaker 882, a receiver 884, an earphone 886, the microphone 888, etc.

The camera module 891 may be a device which captures a still image and a moving image. According to an embodiment, the camera module 891 may include one or more image sensors (e.g., a front sensor or a rear sensor), a lens, an image signal processor (ISP), or a flash (e.g., an LED or a xenon lamp).

The power management module 895 may manage, for example, power of the electronic device 801. According to an embodiment, the power management module 895 may include a power management integrated circuit (PMIC), a charger IC or a battery gauge. The PMIC may have a wired charging method and/or a wireless charging method. The wireless charging method may include, for example, a magnetic resonance method, a magnetic induction method, an electromagnetic method, etc. An additional circuit for wireless charging, for example, a coil loop, a resonance circuit, a rectifier, etc., may be further provided. The battery gauge may measure, for example, the remaining capacity of the battery 896 and voltage, current, or temperature thereof while the battery 896 is charged. The battery 896 may include, for example, a rechargeable battery or a solar battery.

The indicator 897 may display a specific state of the electronic device 801 or part (e.g., the processor 810) thereof, for example, a booting state, a message state, a charging state, etc. The motor 898 may convert an electric signal into mechanical vibration and may generate vibration, a haptic effect, etc. Though not shown, the electronic device 801 may include a processing unit (e.g., a GPU) for supporting a mobile TV. The processing unit for supporting the mobile TV may process media data according to standards, for example, a digital multimedia broadcasting (DMB) standard, a digital video broadcasting (DVB) standard, a mediaFlo™ standard, etc.

Each of the above-mentioned elements of the electronic device according to various embodiments of the present disclosure may be configured with one or more components, and names of the corresponding elements may be changed according to the type of the electronic device. The electronic device may include at least one of the above-mentioned elements, some elements may be omitted from the electronic device, or other additional elements may be further included in the electronic device. Also, some of the elements of the electronic device may be combined with each other to form one entity, thereby making it possible to perform the functions of the corresponding elements in the same manner as before the combination.

Figure 9:
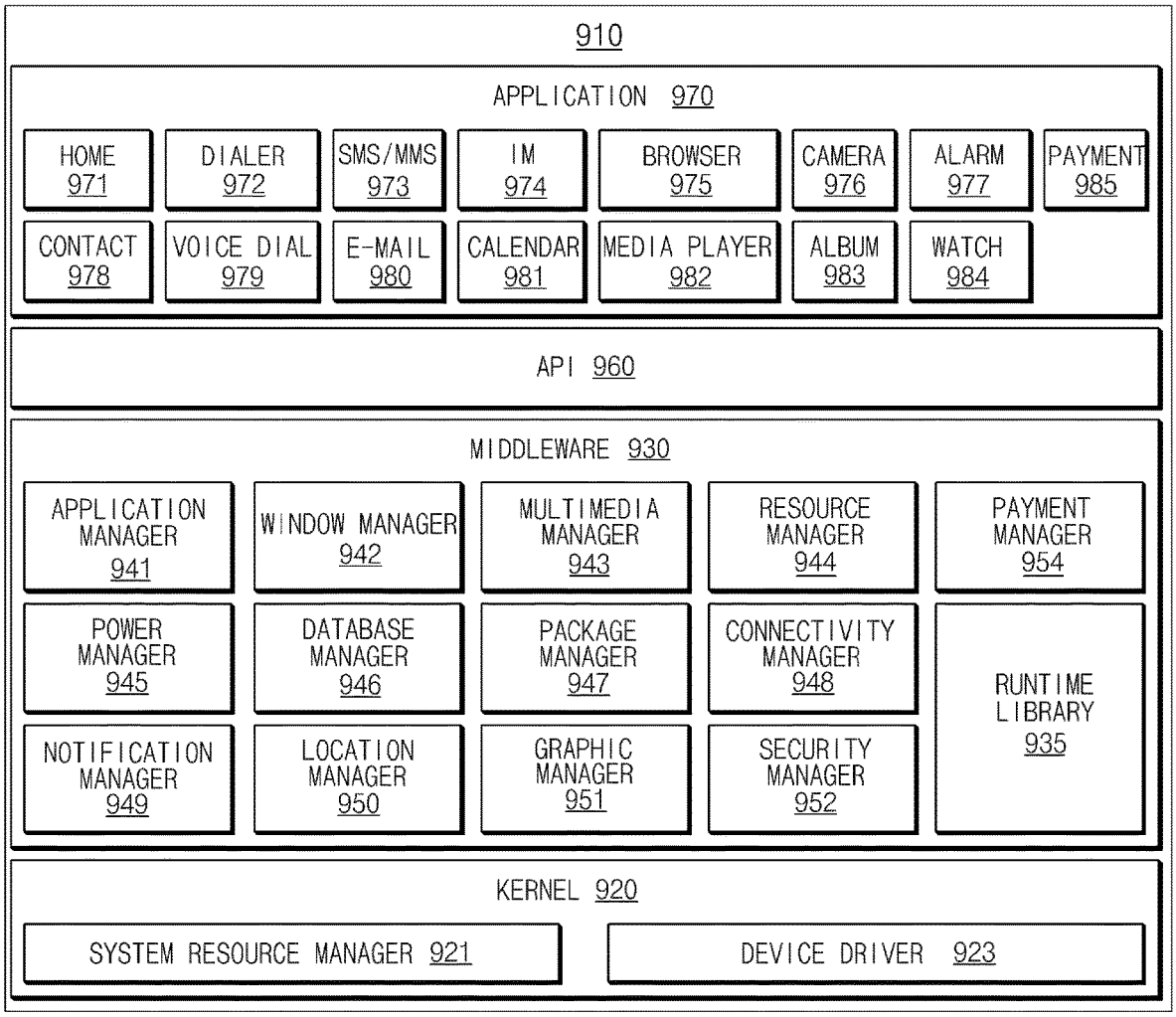
FIG. 9 illustrates a program module according to an embodiment.

FIG. 9 illustrates a program module according to an embodiment.

Referring to FIG. 9, the program module 910 may include an OS for controlling resources associated with an electronic device 701 and/or various applications 747 which are executed on the OS. The OS may be, for example, Android™, iOS™, Windows™, Symbian™, Tizen™, Bada™, etc.

The program module 910 may include a kernel 920, a middleware 930, an API 960, and/or an application 970. At least part of the program module 910 may be preloaded on the electronic device, or may be downloaded from an external electronic device.

The kernel 920 may include, for example, a system resource manager 921 and/or a device driver 923. The system resource manager 921 may control, assign, or collect, and the like system resources. According to an embodiment, the system resource manager 921 may include a process management unit, a memory management unit, a file system management unit, etc. The device driver 923 may include, for example, a display driver, a camera driver, a BT driver, a shared memory driver, a USB driver, a keypad driver, a Wi-Fi driver, an audio driver, or an inter-process communication (IPC) driver.

The middleware 930 may provide various functions to the application 970 such that a function or information provided from one or more resources of the electronic device may be used by the application 970. The middleware 930 may include at least one of a runtime library 935, an application manager 941, a window manager 942, a multimedia manager 943, a resource manager 944, a power manager 945, a database manager 946, a package manager 947, a connectivity manager 948, a notification manager 949, a location manager 950, a graphic manager 951, a security manager 952, or a payment manager 954.

The runtime library 935 may include, for example, a library module used by a compiler to add a new function through a programming language while the application 970 is executed. The runtime library 935 may perform a function about input and output management, memory management, or an arithmetic function.

The application manager 941 may manage, for example, a life cycle of the application 970. The window manager 942 may manage graphic user interface (GUI) resources that are used on a screen of the electronic device. The multimedia manager 943 may identify a format to be used for reproducing various media files and may encode or decode a media file using a coder corresponding to the corresponding format. The resource manager 944 may manage the source code of the application 970, or a memory space of a memory.

The power manager 945 may act together with, for example, a basic input/output system (BIOS) and the like, may manage the capacity, temperature, or power of a battery or a power source, and may provide power information utilized for an operation of the electronic device. The database manager 946 may generate, search, or change a database to be used in the application 970. The package manager 947 may manage installation or update of an application distributed by a type of a package file.

The connectivity manager 948 may manage, for example, a wireless connection or a direct connection between the electronic device and the external electronic device. The notification manager 949 may provide a function to notify a user of an occurrence of a specified event (e.g., an incoming call, message, or alert). The location manager 950 may manage location information of the electronic device. The graphic manager 951 may manage a graphic effect to be provided to the user or a user interface related to the graphic effect.

The security manager 952 may provide all security functions utilized for system security, user authentication, etc. According to an embodiment, when the electronic device 701 has a phone function, the middleware 930 may further include a telephony manager for managing a voice or video communication function of the electronic device.

The middleware 930 may include a middleware module which configures combinations of various functions of the above-described components. The middleware 930 may provide a module which specializes according to the types of OSs to provide a differentiated function. Also, the middleware 930 may dynamically delete some of old components or may add new components.

The API 960 may be, for example, a set of API programming functions, and may be provided with different components according to OSs. For example, in case of Android™ or iOS™, one API set may be provided according to platforms. In case of Tizen™, two or more API sets may be provided according to platforms.

The application 970 may include one or more of, for example, a home application 971, a dialer application 972, a short message service/multimedia message service (SMS/MMS) application 973, an instant message (IM) application 974, a browser application 975, a camera application 976, an alarm application 977, a contact application 978, a voice dial application 979, an email application 980, a calendar application 981, a media player application 982, an album application 983, a clock application 984, a health care application (e.g., an application for measuring quantity of exercise or blood sugar level, etc.), an environmental information application (e.g., an application for providing atmospheric pressure information, humidity information, temperature information, etc.), etc.

According to an embodiment, the application 970 may include an information exchange application for exchanging information between the electronic device 701 and an external electronic device. The information exchange application may include, for example, a notification relay application for transmitting specific information to the external electronic device or a device management application for managing the external electronic device.

For example, the notification relay application may include a function of transmitting notification information, which is generated by other applications (e.g., the SMS/MMS application, the e-mail application, the health care application, the environment information application, etc.) of the electronic device, to the external electronic device. Also, the notification relay application may receive, for example, notification information from the external electronic device, and may provide the received notification information to the user of the electronic device.

The device management application may manage (e.g., install, delete, or update), for example, at least one (e.g., a function of turning on/off the external electronic device itself (or partial components) or a function of adjusting brightness (or resolution) of a display) of functions of the external electronic device which communicates with the electronic device, an application which operates in the external electronic device, or a service (e.g., a call service or a message service) provided from the external electronic device.

According to an embodiment, the application 970 may include an application (e.g., the health card application of a mobile medical device) which is preset according to attributes of the external electronic device. The application 970 may include an application received from the external electronic device. The application 970 may include a preloaded application or a third party application which may be downloaded from a server. Names of the components of the program module 910 according to various embodiments of the present disclosure may differ according to kinds of OSs.

According to various embodiments, at least part of the program module 910 may be implemented with software, firmware, hardware, or at least two or more combinations thereof. At least part of the program module 910 may be implemented (e.g., executed) by, for example, a processor 720. At least part of the program module 910 may include, for example, a module, a program, a routine, sets of instructions, a process, etc., for performing one or more functions.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

According to various embodiments of the present disclosure, at least part of a device (e.g., modules or the functions) or a method (e.g., operations) may be implemented with, for example, instructions stored in computer-readable storage media which have a program module. When the instructions are executed by a processor, one or more processors may perform functions corresponding to the instructions. The computer-readable storage media may be, for example, a memory.

The computer-readable storage media may include a hard disc, a floppy disk, magnetic media (e.g., a magnetic tape), optical media (e.g., a compact disc read only memory (CD-ROM) and a digital versatile disc (DVD)), magneto-optical media (e.g., a to floptical disk), a hardware device (e.g., a ROM, a random access memory (RAM), a flash memory, etc.), etc. Also, the program instructions may include not only mechanical codes compiled by a compiler but also high-level language codes which may be executed by a computer using an interpreter and the like. The above-mentioned hardware device may be configured to operate as one or more software modules to perform operations according to various embodiments of the present disclosure, and vice versa.

Modules or program modules according to various embodiments of the present disclosure may include at least one or more of the above-mentioned components, some of the above-mentioned components may be omitted, or other additional components may be further included. Operations executed by modules, program modules, or other components may be executed by a successive method, a parallel method, a repeated method, or a heuristic method. Also, some operations may be executed in a different order or may be omitted, and other operations may be added.

Embodiments of the present disclosure described and shown in the drawings are provided as examples to describe technical content and help understanding but do not limit the present disclosure. Accordingly, it should be interpreted that besides the embodiments listed herein, all modifications or modified forms derived based on the technical ideas of the present disclosure are included in the present disclosure as defined in the claims, and their equivalents.

The above-described embodiments of the present disclosure can be implemented in hardware, firmware or via the execution of software or computer code that can be stored in a recording medium such as a CD ROM, a DVD, a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or field-programmable gate array (FPGA). As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein.

The control unit may include a microprocessor or any suitable type of processing circuitry, such as one or more general-purpose processors (e.g., ARM-based processors), a digital signal processor (DSP), a programmable logic device (PLD), an ASIC, an FPGA, a GPU, a video card controller, etc. In addition, it would be recognized that when a general purpose computer accesses code for implementing the processing shown herein, the execution of the code transforms the general purpose computer into a special purpose computer for executing the processing shown herein. Any of the functions and steps provided in the drawing figures may be implemented in hardware, software or a combination of both and may be performed in whole or in part within the programmed instructions of a computer. In addition, an artisan understands and appreciates that a "processor" or "microprocessor" may be hardware in the claimed disclosure.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device, comprising:

a display panel including a plurality of pixels, each pixel having at least two sub-pixels; and a display driver integrated circuit, which includes:

a source driver including source amplifiers configured to amplify data signals such that the sub-pixels operate based at least on the amplified data signals;

a first gamma generator for a first sub-pixel of a pixel including a first gamma reference voltage circuit configured to provide at least one reference voltage for the first sub-pixel to a first gamma signal output circuit, the first gamma signal output circuit being configured to output a first gamma signal based on the at least one reference voltage for the first sub-pixel;

a second gamma generator for a second sub-pixel of the pixel including a second gamma reference voltage circuit configured to provide at least one reference voltage for the second sub-pixel to a second gamma signal output circuit, the second gamma signal output circuit being configured to output a second gamma signal based on the at least one reference voltage for the second sub-pixel; and a control circuit for controlling to connect between the first gamma generator and the second gamma generators;

wherein the at least one first reference voltage for the first sub-pixel is provided to the first gamma signal output circuit and the second gamma signal output circuit according to an operation of the control circuit.

2. The electronic device of claim 1, wherein the control circuit is further configured to control to:

provide a gamma reference voltage for the first sub-pixel of the sub pixels as a gamma voltage for the second sub-pixel, if a brightness value of the output signals is within a first brightness range; and provide a gamma voltage corresponding to each of the sub-pixels, if the brightness value of the output signals is within a second brightness range.

3. An electronic device, comprising:

a display panel including a plurality of source channels; and a display driver integrated circuit, which includes:

a source driver including source amplifiers configured to supply signals to the source channels, respectively, and decoders connected with input terminals of the source amplifiers, respectively;

a gamma generator configured to supply gamma voltages to the source driver; and a timing controller configured to control gamma voltage generation of the gamma generator, wherein the gamma generator includes:

circuit devices for sub-pixels, the circuit devices configured to supply the gamma voltages to the decoders; and a switch configured to selectively connect a first circuit device among the circuit devices, which is configured to supply a first gamma voltage to a first decoder among the decoders, with a second circuit device configured to supply a second gamma voltage to a second decoder among the decoders, in response to a control signal.

4. The electronic device of claim 3, wherein the circuit devices for the sub-pixels comprise:

a digital gamma block configured to:

supply a gamma setting value of a specified sub-pixel among the sub-pixels in a first screen display configuration, and supply a gamma setting value of each of the sub-pixels in a second screen display configuration, which is different from the first screen display configuration; and an analog gamma block configured to:

generate the gamma tap voltages based on the gamma setting value received from the digital gamma block, and supply the gamma voltages corresponding to the generated gamma tap voltages to the decoders, respectively.

5. The electronic device of claim 4, wherein the first screen display configuration comprises a lower-brightness screen display configuration for driving the display panel below a specified brightness, and wherein the second screen display configuration comprises a higher-brightness screen display configuration for driving the display panel at or above the specified brightness.

6. The electronic device of claim 4, wherein the analog gamma block comprises:

gamma adjustment circuits configured to generate gamma reference voltages corresponding to the sub-pixels, respectively, based on gamma setting values; and gamma register strings configured to generate the gamma voltages based on the gamma reference voltages.

7. The electronic device of claim 6, wherein the switch is interposed between a first gamma adjustment circuit that corresponds to the specified sub-pixel, among the gamma adjustment circuits, and a first gamma register string, which corresponds to another sub-pixel, among the gamma register strings.

8. The electronic device of claim 4, wherein the analog gamma block comprises:

a first gamma adjustment circuit configured to generate a first gamma reference voltage based on a first gamma setting value corresponding to a blue sub-pixel;

a second gamma adjustment circuit configured to generate a second gamma reference voltage based on a second gamma setting value corresponding to a green sub-pixel;

a third gamma adjustment circuit configured to generate a third gamma reference voltage based on a third gamma setting value corresponding to a red sub-pixel;

a first gamma register string configured to supply a first gamma voltage corresponding to the blue sub-pixel, based on an output of the first gamma adjustment circuit;

a second gamma register string configured to supply a second gamma voltage corresponding to the at least one green sub-pixel, based on an output of the second gamma adjustment circuit;

a third gamma register string configured to supply a third gamma voltage corresponding to the red sub-pixel, based on an output of the third gamma adjustment circuit;

a first switch interposed between an output terminal of the first gamma adjustment circuit and an input terminal of the third gamma register string; and a second switch interposed between an output terminal of the first gamma adjustment circuit and an input terminal of the second gamma register string.

9. The electronic device of claim 3, wherein the circuit devices for the sub-pixels comprise:

a digital gamma block configured to:

calculate a first gamma setting value of a specified sub-pixel, that corresponds to a second gamma setting value of another sub-pixel, based on a gamma curve of the specified sub-pixel in a first screen display configuration for driving the display panel below a specified brightness, and supply the first calculated gamma setting value; and an analog gamma block configured to:

generate the gamma tap voltages based on the first calculated gamma setting value received from the digital gamma block, and supply a gamma voltages corresponding to the generated gamma tap voltages to the decoders, respectively.

10. The electronic device of claim 3, wherein the timing controller is further configured to:

receive a control signal associated with a screen display configuration of the display panel; and generate the gamma voltages using some of circuit devices for the sub-pixels and supply the generated gamma voltages to the sub-pixels in a time-division manner, if the control signal instructs that the display panel is to be displayed below a specified brightness.

11. The electronic device of claim 10, wherein the timing controller is further configured to:

turn off remaining circuit devices, other than the some of the circuit devices associated with the generation of the gamma voltages.

12. A method of operating an electronic device using a gamma voltage of a display panel including a plurality of channels, the method comprising:

determining a screen display configuration of the display panel;

if the determined screen display configuration is a first screen display configuration, supplying gamma voltages to sub-pixels by using some of circuit devices for the sub-pixels, which supply the gamma voltages to source channels; and if the determined screen display configuration is a second screen display configuration, which is different from the first screen display configuration, supplying second gamma voltages to the sub-pixels by using each of the circuit devices for the sub-pixels, which supply the gamma voltages to the source channels.

13. The method of claim 12, wherein the first screen display configuration includes at least one of a configuration for driving the display panel below a specified brightness, a configuration for displaying only a specified object, and a configuration for displaying a screen in a specified color.

14. The method of claim 12, wherein the first screen display configuration includes a configuration for driving the display panel at or above a specified brightness, and wherein the second screen display configuration includes a configuration for displaying an execution screen of a specified application associated with reproduction of a moving picture.

15. The method of claim 12, wherein, in the first screen display configuration, supplying the gamma voltages comprises connecting a first circuit device that supplies a gamma voltage to a first decoder, with a second circuit device, which supplies the gamma voltage to a second decoder, using a switch for sub-pixel driving duration corresponding to the second decoder, in response to a control signal.

16. The method of claim 12, wherein, in the first screen display configuration, supplying the gamma voltages comprises generating a gamma tap voltage for each sub-pixel based on a first gamma setting value of a specified sub-pixel.

17. The method of claim 16, wherein, in the first screen display configuration, supplying the gamma voltages further comprises calculating a second gamma setting value corresponding to a third gamma setting value of another sub-pixel, based on a gamma curve of the specified sub-pixel.

18. The method of claim 16, wherein, in the first screen display configuration, supplying the gamma voltages further comprises calculating a second gamma setting value corresponding to a third gamma setting value of a Red sub-pixel or a Green sub-pixel, based on a gamma curve of a Blue sub-pixel.

19. The method of claim 12, wherein, in the second screen display configuration, supplying the gamma voltages comprises generating a gamma tap voltage for each sub-pixel based on a gamma setting value for each sub-pixel.

20. The method of claim 12, wherein, in the first screen display configuration, supplying the gamma voltages comprises cutting off power to other of the circuit devices, except for the some of the circuit devices.

* * * * *